US005622571A

United States Patent [19]

Derlein

[11] Patent Number: 5,622,571

[45] Date of Patent: Apr. 22, 1997

[54] PIPE CLEANING MODULES AND SYSTEMS AND METHODS FOR THEIR USE

[75] Inventor: Donald A. Derlein, Albuquerque, N.M.

[73] Assignee: Pipeline Services, Inc., Dallas, Tex.

[21] Appl. No.: 429,051

[22] Filed: Apr. 26, 1995

Related U.S. Application Data

[60] Division of Ser. No. 903,237, Jun. 15, 1992, Pat. No. 5,435,854, which is a continuation-in-part of Ser. No. 647, 144, Jan. 29, 1991, abandoned, which is a continuation-in-part of Ser. No. 567,309, Aug. 10, 1990, Pat. No. 5,122,193.

[51] Int. Cl.[6] ..... B08B 9/06

[52] U.S. Cl. ..... 134/22.11; 134/111; 134/167 C; 15/302; 210/241

[58] Field of Search ..... 15/302, 320, 321; 210/241; 134/111, 167 C, 168 C, 169 C, 172, 22.12, 22.11

[56] References Cited

U.S. PATENT DOCUMENTS

| | | | |
|---|---|---|---|
| Re. 27,346 | 4/1972 | Naylor | 134/182 |
| 1,331,239 | 2/1920 | Cartwright | 210/409 |
| 1,331,900 | 2/1920 | Cartwright | 210/409 |
| 1,688,012 | 10/1928 | Gray | 134/110 |
| 2,465,921 | 3/1949 | Peters | 134/8 |
| 2,735,122 | 2/1956 | Pletcher | 15/104.3 |
| 2,858,556 | 11/1958 | Van Der Lans | 15/104.3 |
| 2,910,720 | 11/1959 | Smith | 15/320 |
| 2,964,191 | 12/1960 | Arnold et al. | 210/241 |
| 3,004,278 | 10/1961 | Stanley | 15/319 |
| 3,112,263 | 11/1963 | Ellila . | |
| 3,181,192 | 5/1965 | Truman | 15/104.3 |
| 3,261,470 | 7/1966 | Daniels | 210/407 X |
| 3,351,968 | 11/1967 | Masters | 15/104.3 |
| 3,444,578 | 5/1969 | Caperton | 15/104.3 |
| 3,630,365 | 12/1971 | Woodbridge et al. | 219/152 |
| 3,658,589 | 4/1972 | Shaddock | 134/10 |
| 3,835,999 | 9/1974 | Moore | 210/407 X |
| 3,842,461 | 10/1974 | Wurster | 15/340.1 |
| 3,923,341 | 12/1975 | Miller | 15/320 X |
| 3,959,845 | 6/1976 | Cradeur et al. | 15/321 |
| 3,989,184 | 11/1976 | Albishausen et al. | 15/340.1 |
| 4,040,960 | 8/1977 | Taylor et al. | 210/96 R |

(List continued on next page.)

FOREIGN PATENT DOCUMENTS

| | | | |
|---|---|---|---|
| 667610 | 6/1929 | France . | |
| 314059 | 8/1919 | Germany . | |
| 686519 | 1/1940 | Germany | 15/320 |
| 3740705 | 6/1989 | Germany | 15/321 |
| 57-29243 | 6/1982 | Japan | 134/104.1 |
| 1255851 | 12/1971 | United Kingdom . | |
| 1460031 | 12/1976 | United Kingdom | 210/241 |

OTHER PUBLICATIONS

WO 93/03218 Feb. 1993 15/321.

*Primary Examiner*—Frankie L. Stinson
*Attorney, Agent, or Firm*—Sidley & Austin

[57] ABSTRACT

A cleaning module for cleaning sewer pipes including sewer liner, and other types of conduits. The cleaning module may comprise a single hydraulically propelled unit, wedge-shaped and selected to fit pipe size. Pipeline walls are scoured by the slurry agitation produced by hydraulic pressure jets in the module. Alternatively, the module is assembled in situ and the relative size of components is selected depending upon the diameter of the pipeline. The module may comprise a front unit and rear unit or a frame assembly and a drive assembly. The modules contain a motor, preferably a hydraulic motor. The motor drives flails, thereby disintegrating solid waste or generating and propelling a sludge slurry. The slurry scours the pipeline walls by cavitation and abrasion action. Also disclosed are systems for cleaning a sewage line section and methods of their use. A system for cleaning pipelines is described which utilities and recycles, as a solid waste transport medium, nearly one hundred percent of the extracted liquid waste. The mobile extractor and separator unit comprises a separator for separating sludge waste from liquid and particulate waste, and for separating liquid waste from particulate waste. The mobile extractor and separator unit of the present invention also employs gravity and a conveyor belt or screw auger to transport the sludge waste.

26 Claims, 23 Drawing Sheets

U.S. PATENT DOCUMENTS

| | | | |
|---|---|---|---|
| 4,121,915 | 10/1978 | Anderson | 55/227 |
| 4,134,174 | 1/1979 | Flynn et al. | 15/302 |
| 4,160,734 | 7/1979 | Taylor et al. | 210/96.1 |
| 4,199,837 | 4/1980 | Fisco, Jr. | 15/302 |
| 4,200,535 | 4/1980 | Kennedy, Jr. | 210/241 |
| 4,207,647 | 6/1980 | Masters | 15/302 |
| 4,214,988 | 7/1980 | Naffziger | 210/407 X |
| 4,216,561 | 8/1980 | Clifford | 15/104.3 R |
| 4,218,803 | 8/1980 | Clifford | 15/104.3 R |
| 4,227,893 | 10/1980 | Shaddock | 55/97 |
| 4,229,852 | 10/1980 | Brobeck | 15/3.5 |
| 4,234,980 | 11/1980 | DiVito et al. | 15/302 |
| 4,250,038 | 2/1981 | Dryden | 210/409 |
| 4,322,868 | 4/1982 | Wurster | 15/302 |
| 4,326,893 | 4/1982 | Clifford | 134/8 |
| 4,337,096 | 6/1982 | Clifford | 134/8 |
| 4,356,039 | 10/1982 | Clifford | 134/8 |
| 4,389,314 | 6/1983 | Petretti | 210/241 |
| 4,418,437 | 12/1983 | French | 15/104.09 |
| 4,436,622 | 3/1984 | Petretti | 210/232 |
| 4,443,908 | 4/1984 | Wiedemann | 15/302 |
| 4,473,921 | 10/1984 | Weber et al. | 15/304 |
| 4,475,260 | 10/1984 | Beck | 15/104.12 |
| 4,508,577 | 4/1985 | Conn et al. | 134/1 |
| 4,520,524 | 6/1985 | Long, Jr. | 15/104.3 R |
| 4,525,277 | 6/1985 | Poulin | 210/601 |
| 4,530,131 | 7/1985 | Zell et al. | 15/302 X |
| 4,578,198 | 3/1986 | Schmidt | 210/780 |
| 4,594,153 | 6/1986 | Weis | 210/104 |
| 4,616,377 | 10/1986 | Urbani | 15/302 |
| 4,619,015 | 10/1986 | Urbani | 15/302 |
| 4,652,368 | 3/1987 | Ennis et al. | 210/97 |
| 4,655,916 | 4/1987 | Schlesiger | 210/173 |
| 4,657,449 | 4/1987 | Marick | 409/143 |
| 4,659,262 | 4/1987 | van Aalst | 406/29 |
| 4,672,710 | 6/1987 | Urbani | 15/302 |
| 4,696,073 | 9/1987 | Urbani | 15/302 |
| 4,707,277 | 11/1987 | Mims | 210/805 |
| 4,764,180 | 8/1988 | Shaddock | 29/157 C |
| 4,773,115 | 9/1988 | Smith | 15/104.12 |
| 4,818,419 | 4/1989 | Mims | 210/796 |
| 4,819,314 | 4/1989 | Shaddock | 29/157 C |
| 4,896,686 | 1/1990 | Schmidt, Jr. et al. | 134/167 C |
| 4,929,353 | 5/1990 | Harris | 210/237 |
| 4,935,984 | 6/1990 | Bryant et al. | 15/302 |
| 4,944,873 | 7/1990 | Williams | 210/209 |
| 4,993,443 | 2/1991 | Buchert | 134/167 C |
| 5,062,963 | 11/1991 | Marcinkowski et al. | 210/712 |
| 5,068,940 | 12/1991 | Sheppard et al. | 15/104.31 |
| 5,086,842 | 2/1992 | Cholet | 166/312 |
| 5,090,079 | 2/1992 | Allison et al. | 15/104.31 |
| 5,129,957 | 7/1992 | Sheppard et al. | 134/22.11 |
| 5,244,505 | 9/1993 | Allison et al. | 134/22.11 |

PIPE CLEANING MODULES AND SYSTEMS AND METHODS FOR THEIR USE

CROSS-REFERENCE TO RELATED APPLICATIONS

This application is a division of U.S. patent application Ser. No. 07/903,237, filed Jun. 15, 1992 by Donald A. Derlein, now U.S. Pat. No. 5,435,854; which is a continuation-in-part application of U.S. patent application Ser. No. 07/647,144, filed on Jan. 29, 1991 by Donald A. Derlein, now abandoned; which is a continuation-in-part application of U.S. patent application Ser. No. 07/567,309, filed on Aug. 10, 1990 by Donald A. Derlein, now U.S. Pat. No. 5,122,193.

BACKGROUND OF THE INVENTION

1. Field of the Invention (Technical Field)

The invention relates to modular pipe cleaning apparatuses particularly useful for sewage lines enabling non-disruptive cleaning and relining preparation, and systems and methods for their use.

2. Background Art

The sewage cleaning art is replete with devices, either towed or self-propelled, for cleaning the interior of sewer pipes. Such cleaning is periodically necessary to remove accumulated sludge and sediment. Further, sewer pipe cleaning forestalls the corrosion of concrete sewer pipes by removing the hydrogen sulfide reactant in the formation of sulfuric acid, which actively attacks such concrete pipes.

One means of preventing further corrosive attack of concrete pipes is the installation of polyethylene slip liners within the pipes. These liners resist sulfuric acid corrosion and can extend the active life of the sewer pipe an estimated one hundred to one hundred fifty years.

Prior to installation of slip liners, the sewer line must be thoroughly cleaned. All sludge and sediment must be removed from the pipe channel itself. Further, and of more concern, deleterious scale deposits built up upon the brittle concrete pipes themselves must be removed without damage to such pipes.

U.S. Pat. No. 2,465,921 to Peters, entitled *Method of Cleaning Flues,* discloses a method of cleaning flues comprising power driven flexible brushes and chains.

U.S. Pat. No. 3,004,278, to Stanley, entitled *Pipe Cleaning Apparatus,* teaches a self-propelled pipe cleaning apparatus comprising a power driven rotatable head supported by idler wheels.

U.S. Pat. No. 4,473,921, to Weber, et al., entitled *Cleaning Device for the Internal Peripheral Surfaces of Pipelines or Hollow Cylindrical Vessels, Especially for Manipulators for the Interior of Pipes,* teaches a pipeline cleaning apparatus comprising several "heads" connected by universal joints.

French Patent FR 667,610 and German Patent DT 314,059 also appear to disclose pipeline cleaning devices.

U.S. Pat. No. 3,181,192, to Truman, entitled *Bucket for Sewer Cleaning,* discloses a clam shell type bucket for removing limited amounts of sediment and sludge by being dragged through a sewer line. U.S. Pat. No. 2,858,556, to Van der Lans, entitled *Self-Propelled Sewer Pipe Cleaning Apparatus,* teaches a self-propelled sewer cleaning apparatus having a retractable flap for cleaning the bottom of the pipe channel.

U.S. Pat. No. 4,418,437, to French, entitled *Pipe Cleaning Apparatus,* discloses self-propelled pipe bore cleaning apparatus having hydraulic jacks. U.S. Pat. No. 4,657,449, to Marich, et al., entitled *Internal Sewage Line Stub Cutting Tool Having Automatic Bit Adjustment,* discloses a towed device for cutting stub pipes in a sewer line. U.S. Pat. No. 4,773,115, to Smith, entitled *Sewer Cleaning Device,* teaches a sewer cleaning device which is periodically hydraulically locked in position in a sewer line to cut away obstructions.

The present invention provides several embodiments of sewer cleaning modules. The preferred embodiment provides a sewer cleaning module designed to dredge heavy compacted sewer sludge. Alternative embodiments primarily provide scale deposit removal.

SUMMARY OF THE INVENTION (DISCLOSURE OF THE INVENTION)

The invention relates to modular pipe cleaning apparatuses, systems incorporating such apparatus, and methods for using the apparatus and the systems. The invention is particularly useful for cleaning sewer lines.

The preferred pipe cleaning module of the invention comprises a single wedge-shaped unit insertable into the pipe. The unit is hollow, preferably having two interior compartments, one for retaining ballast materials, the other rearwardly-disposed compartment to serve as a water pressure chamber. The ballast compartment is accessible for inserting or removing ballast material. Disposed upon the rear of the pressure compartment, and piercing the rear wall of the module are a plurality of orifices serving as water jets to propel the module and agitate pipe sediments. A flexible hose or hoses joined to the rearward pressure compartment provides water pressure to the water jets. The module is fitted with exterior runner rails to facilitate movement within the pipe.

An alternative pipe cleaning module of the invention comprises a main unit or a forward unit and a rear unit fitable into the pipe, and a hinge assembly connecting the forward unit and the rear unit. The forward Unit contains a motor, whereas the rear unit contains a pump. The forward unit and rear unit comprise arcuate segments, circumferentially secured to one another. The forward unit comprises a yoke, with a longitudinally extending tongue and a connector detachably engaged by a crossbar. The crossbar has a towing cable attachment. The forward unit also comprises a slurry agitating mechanism, such as a plurality of flails. These flails are driven by the motor disposed in the forward unit.

In another alternative embodiment, the invention comprises a forward unit for a pipe cleaning module, an annulus having forwardly projecting teeth; a vibrator mechanism for vibrating the annulus; a towing harness attached to the annulus and extending forwardly of the annulus; and a cable attached to the annulus and extending rearwardly of the annulus. The annulus comprises a plurality of toothed arcuate segments, with skids and fins. Alternate ones of the plurality of toothed arcuate segment means comprise fore-and-aft staggered apertures and the towing harness and cable are attached to the fore-and-aft staggered apertures.

An alternative embodiment of the invention comprises a sewer cleaning module adapted to clean a sewage line section. The module comprises a frame assembly having a plurality of preformed segmental support members interconnected by longitudinally extending ribs; a plurality of flap valves mounted peripherally about one end of the frame assembly; a drive assembly mounted coaxially with the frame assembly, the drive assembly having a motor and shaft; and the shaft being eccentrically mounted relative to the sewage line section.

In another alternative embodiment, the plurality of preformed segmental support members are circumferentially secured to each other. The frame assembly includes a yoke comprising slidable longitudinally extending members detachably engaged by a crossbar at one end thereof. The longitudinally extending members are slidably and pivotally mounted in lateral journal bearings and are detachably secured to the frame assembly at the other end thereof. The crossbar includes a towing cable attachment and locking means thereon.

Another alternative embodiment of the sewer cleaning module comprises a plurality of cutters mounted proximate to the flap valves.

Yet another alternative embodiment of the invention comprises the drive assembly mounted within the frame assembly.

Preferably, the drive assembly comprises a plurality of nozzles at one end thereof. The drive assembly preferably comprises a slotted housing adapted to be secured to the frame assembly. The slotted housing preferably comprises an access port and a vent at the other end thereof.

The preferred embodiment of the drive assembly comprises a motor operatively connected to a shaft by gears. Preferably, the motor is a hydraulic motor; alternatively, the motor may be an electric or pneumatic motor. Preferably, the hydraulic motor includes hoses, manifolds, flow dividers, a pump, and an accumulator in circuit therewith. The pump is adapted to pump liquid sewage through the nozzle.

In an alternative embodiment, an output shaft is concentrically mounted on and secured to the shaft by a shear pin. Preferably, the output shaft means comprises flails and an impeller mounted thereon. Alternatively, the output shaft may comprise cutters mounted thereon.

The preferred embodiment of the invention further provides a method comprising the steps of extracting waste slurry from a pipeline, separating the waste slurry into solid waste and liquid waste, moving the solid waste to a receptacle, and recycling substantially all the liquid waste through the pipeline. The method may further comprise the steps of screening the slurry and running it through a cyclone separator. The method may also comprise the step of conveying the solid waste away from the apparatus. The preferred method may also comprise the step of returning the liquid waste to the pipeline at a point upstream from the point of slurry extraction, and may also comprise the step of pumping at least a portion of the returned liquid waste through a cleaning module to propel the module. The method may also comprise the step of transporting solid waste off-site simultaneously with the extraction and separation of slurry.

An alternative embodiment of the invention further provides a method of using the sewer cleaning method comprising the steps of positioning sewer cleaning module components upstream of a sewage line section, lowering the components into the sewage line section, assembling the components into a sewer cleaning module, connecting the module to a power unit and a towing unit, and providing power to the module while simultaneously towing the module. The method may further comprise the steps of agitating and dredging the sewage. The method may further comprise the steps of generating a sewage slurry forwardly of the module, or rending and withdrawing the sewage slurry rearwardly of the module. The method may further comprise the steps of flailing and liquefying the sewage to generate the sewage slurry. The method may further comprise the steps of extracting the slurry, separating the slurry into sludge and liquid waste, returning the liquid waste to the line while retaining the sludge.

The preferred embodiment of the invention also comprises a sewage line cleaning system comprising, in combination, a power unit, a sewer cleaning module, and an extraction and separation unit. Preferably, the units are mobile and the power unit supplies hydraulic pressure to the sewer cleaning module. Preferably, all the units are mounted on a single vehicle. Alternatively, the power unit and sewer cleaning module may be mounted on a vehicle separate from the extraction and separation unit. The sewage cleaning module generates a sewage slurry.

An alternative embodiment of the invention comprises a sewage line cleaning system comprising, in combination, a power unit, a sewer cleaning module, an extraction and separation unit, and a towing unit. Preferably, the units are mobile and the power unit supplies hydraulic power to the sewer cleaning module. Alternatively, the power unit supplies electric or pneumatic power to the sewer cleaning module. The sewage cleaning module generates and propels a sewage slurry.

In an alternative embodiment of the sewer cleaning system, the extraction and separation unit is sited intermediate the power unit and the towing unit. In the preferred embodiment, the extraction and separation unit is sited at the power unit.

In all embodiments, the mobile extraction and separation unit extracts the sewage slurry, containing solid waste and liquid waste, from the sewage line, separates the slurry into solid and liquid waste, and returns the liquid waste to the sewage line. The solid waste, containing sludge waste and particulate waste may be separated from each other and the liquid waste, e.g., by screening and/or cycloning.

In the alternative embodiments, the towing unit tows the sewer cleaning module at a rate commensurate with sediment load, scale deposits, degree of compaction, and total volume of sewage.

The preferred embodiment of the invention comprises a method of cleaning a sewage line section comprising the steps of transporting and positioning a power unit, a sewer cleaning module, and an extraction and separation unit over a sewage line section to be cleaned; lowering the sewer cleaning module and a slurry pump into the sewage line section, installing a flow baffle in the line down stream from the slurry pump; providing extraction hose means between the slurry pump and the extraction and separation unit, providing return hose means between the power unit and the sewer cleaning module; and supplying water pressure to the sewer cleaning module.

The alternative embodiment of the invention comprises a method of cleaning a sewage line section comprising the steps of transporting and positioning a power unit, sewer cleaning module components, an extraction and separation unit, and a towing unit over and along a sewage line section to be cleaned; lowering the sewer cleaning module components into the sewage line section; assembling the sewer cleaning module components into a sewer cleaning module; lowering extraction and return hose means from the extraction and separation unit; connecting the sewer cleaning module to the towing unit and the power unit; and providing power to the sewer cleaning module while simultaneously towing the module through the sewage line section at a rate commensurate with sediment load, amount of scale deposit, degree of compaction and total volume of sewage.

An alternative method of cleaning a sewage line includes the additional steps of siting the extraction and separation unit intermediate the power unit and the towing unit. Preferably, the extraction and separation unit is sited at the power unit.

An alternative method of cleaning a sewage line section includes the additional steps of generating and propelling a sewage slurry by agitating and liquefying the sewage forwardly of the module, extracting and separating the slurry into sludge and liquid waste, and returning the liquid waste to the line.

Alternatively, the steps of generating and propelling the sewage slurry include the steps of rending and withdrawing the sewage slurry rearwardly of the module.

The preferred embodiment of the method of cleaning a sewage line section further comprises the steps of disconnecting, disassembling, and raising the sewer cleaning module components, and transporting and repositioning the power unit, sewer cleaning module components, extraction and separation unit and towing unit over and above another sewage line section.

An object of the invention is the provision of a portable sewer cleaning module which is of simple construction with no moving parts.

Another object of the invention is the provision of a portable sewer cleaning module which may be assembled and disassembled in situ.

Another object of the invention is the provision of a sewer cleaning module adapted to fit varying pipeline diameters.

A further object of the invention is a method for generating a sewage slurry whereby deleterious pipeline scale deposits are removed by the cavitation and fluid abrasion action of such slurry.

Yet another object of the invention is the provision of a sewer cleaning system utilizing a sewer cleaning module, a power unit, an extraction and separation unit and a towing unit.

Yet another object of the invention is the provision of a sewer cleaning system which utilizes water jet propulsion of a cleaning module in lieu of a towing unit.

A principal advantage of the invention is the provision of a sewer cleaning system which filters and recirculates sewer water, eliminating the need to import large quantities of cleaning water.

Another advantage of the present invention is the provision of a sewer cleaning module system and methods whereby pipeline cleaning is effected without excavation or interruption of sewage flow and with minimal street traffic disruption.

Another advantage of the present invention is the provision of a means for transporting extracted solid wastes off-site simultaneously with the ongoing extraction and separation of solid and liquid waste.

Another advantage of the invention is the provision of an economical sewer cleaning system that does not receive scraping or scaling of brittle pipeline walls by mechanical implements.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention.

DETAILED DESCRIPTION OF THE PREFERRED EMBODIMENTS OF THE INVENTION (BEST MODES FOR CARRYING OUT THE INVENTION)

The invention relates to improved sewer cleaning modules, systems employing such modules, and methods for their use. The sewer cleaning modules, while designed primarily for sewage line cleaning purposes, are of general application. As such, they, as well as all the apparatuses and systems of the invention may be used in cleaning oil pipelines, water mains, and the like. The discussion herein pertaining to sewage and sewage lines is applicable to other wastes, slurries, conduit, channels (open and closed) and pipelines.

Figure 25:
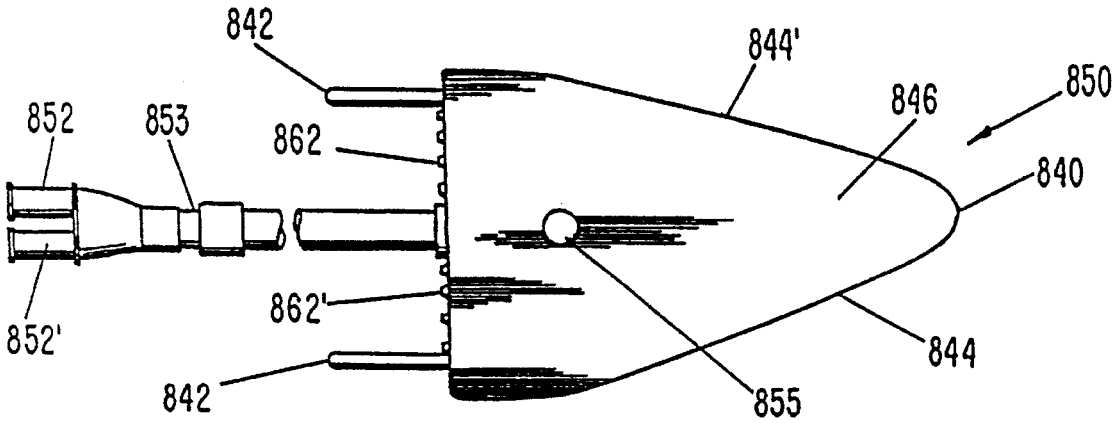
FIG. 25 is a top view of the preferred embodiment of the sewer cleaning module of the invention.
Figure 26:
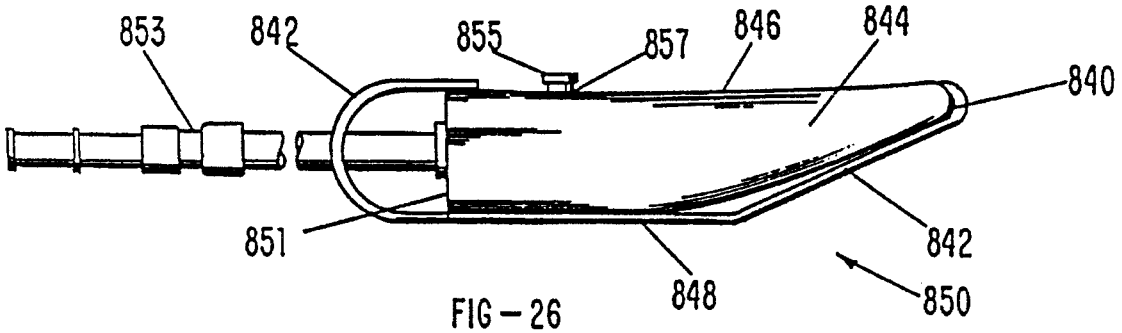
FIG. 26 is a side view of the FIG. 25 embodiment.
Figure 27:
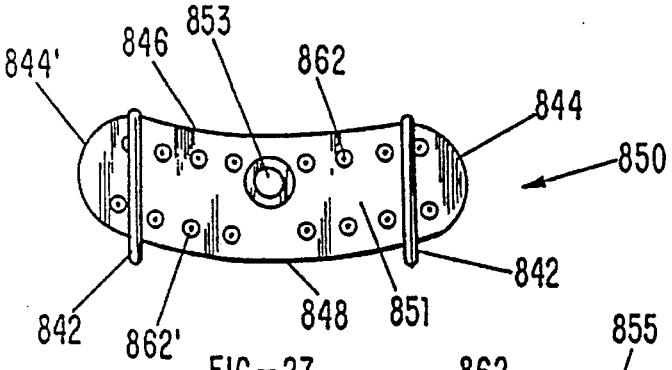
FIG. 27 is a rear view of the FIG. 25 embodiment.
Figure 28:
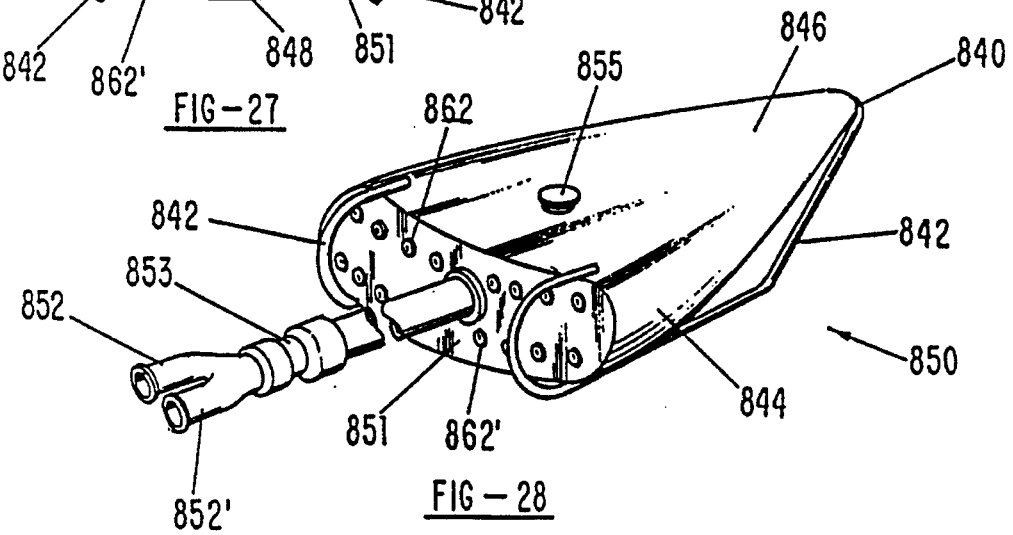
FIG. 28 is a perspective view of the FIG. 27 embodiment.
Figure 32:
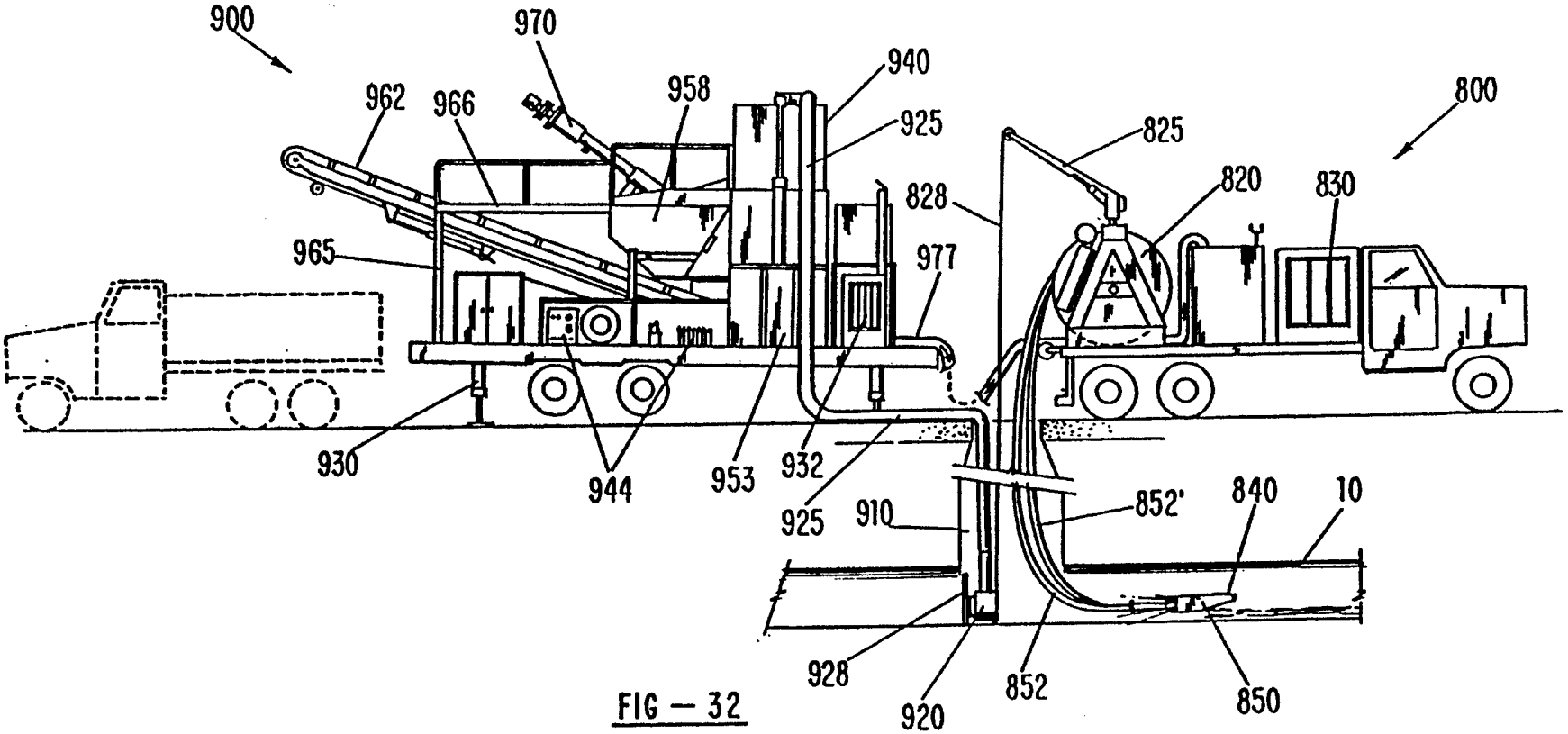
FIG. 32 is a side view of the preferred embodiment of the sewer cleaning system of the invention.

Reference is made to FIGS. 25–28, showing the preferred embodiment of the sewer cleaning module 850 of the invention. Cleaning module 850 consists of a hollow, generally wedge-shaped unit manufactured from durable, corrosion-resistant material such as stainless steel or the like. As best shown in FIG. 26, the forward portion of the bottom 848 of module 850 curves upwardly to an upturned front nose 840. Also, as shown in FIG. 25, the sides 844,844' of cleaning module 850 are tapered inwardly toward front nose 840. FIG. 27 illustrates that cleaning module 850 may be best adapted for use in tubular pipes by having a slightly concave top 846, concave bottom 848, and convex rounded sides 844,844'. Module 850 is fitted with skid runners 842 to minimize friction with the walls of sewer line 10 (FIG. 32). As best shown in FIG. 28, therefore, cleaning module 850 is somewhat sled-shaped, to allow it to be inserted into and move easily along and within sewer line 10.

Module 850 preferably comprises two interior chambers (not shown), separated by an interior wall disposed generally parallel to the back 851. The forward ballast chamber may be accessed through ballast hatch 857, reversibly closed by cap 855. The user of the invention thus may adjust the quantity and weight of ballast (e.g. lead or steel pellets or the like) within module 850, to adapt the buoyancy of cleaning module 850 to the local conditions within the line to be cleaned 10 and assure eccentric disposition relative to line 10.

Piercing back 851 are at least one, preferably a plurality, of orifices with nozzles, constituting pressure jets 862,862'. Water under pressure is supplied to the interior of cleaning module 850 through pressure hoses 852,852' attached to back 851 by swivel connection 853. Water enters the rear pressure chamber (not shown) of module 850, and exits with high velocity through pressure jets 862,862'. Reaction to the force of water exiting through pressure jets 862,862' serves to propel cleaning module 850 forward upstream) in the line to be cleaned 10, as best shown in FIG. 32.

Reference briefly is made to FIG. 32. Streams of water squirted from pressure jets 862,862' create an agitating turbulence immediately behind (downstream) from module 850; the water streams dislodge accumulated sediments and sludges within line 10, push them into the sewage flow, and wash them downstream to slurry pump 920. Unable to pass flow baffle 928, the sludge and sediments are sucked into slurry pump 920 and pumped up to the extraction and separator unit 900. Throughout this disclosure, "sludge" shall mean the assorted solid sediments, debris, scale, particulates and muck that routinely accumulate within pipelines over time.

Reference is made to FIG. 32, showing the preferred embodiment of a system for cleaning a sewage line section comprises, in combination, mobile power unit 800, sewer cleaning module 850 and mobile extractor and separator unit 900. In the preferred embodiment of the system, all units are mobile and are positioned over and along a sewage line section 10 to be cleaned. FIG. 32 illustrates a configuration of the preferred embodiment of the system having power unit 800 and extractor and separator unit 900 mounted upon separate wheeled vehicles; preferably, both power unit 800 and extractor and separator unit 900 are mounted upon the chassis of a single vehicle.

In the preferred embodiment of the system, extractor and separator unit 900 and power unit 800 are sited at a single manhole 910 or other line access point, downstream from the line section 10 to be cleaned. Preferred embodiment of sewer cleaning module 850 is lowered into the sewage line 10, and aimed with its front 840 (see FIG. 25) directed upstream. Cleaning module 850 is connected to power unit 800 by one or more pressure hoses 852,852', leading from a large capacity water tank mounted on power unit 800 chassis. Water pressure is supplied to cleaning module 850 from power unit 800 via flexible, heavy-duty pressure hoses 852,852' at a rate commensurate with the sediment load, amount of scale deposit, degree of compaction, and total volume of sewage. Water pressure through pressure jets 862,862' (FIG. 27) in cleaning module 850 propels cleaning module 850 upstream, displacing and flushing away accumulated scale and sludge. As further explained hereinafter, water pressure to cleaning module 850 preferably, but not necessarily, is supplied by pumping, filtered liquid sewer waste through pressure hoses 852,852' to cleaning module 850.

With continued reference to FIG. 32, extraction and separator unit 900 is also situated near the line 10 to be cleaned. A slurry pump 920 is lowered down manhole 910 and disposed within line 10 downstream from cleaning module 850. Slurry pump 920 is a hydraulic pump capable of lifting liquid wastes and disturbed sludges up the flexible, heavy-duty, slurry hose 925 and into the upper portion of the extraction and separator unit 900. Slurry pump 920 is raised and lowered using flexible withdrawal cable 828 dropped from crane 825 mounted on mobile power unit 800. Throughout this disclosure, "liquid waste" shall mean contaminated water and other liquids commonly occurring in sewer and other pipelines. "Slurry" shall mean a fluid composed of liquid waste mixed with suspended particulates and sludge. "Solid waste" shall mean slurry from which most of the liquid waste has been removed.

Prior to system operation, a flow baffle 928 is temporarily installed in line 10 immediately downstream from slurry pump 920. Flow baffle 928 partially occludes line 10, and serves to check the movement of agitated sludge and slurry past slurry pump 920, while permitting some passage of sewer water downstream.

Figure 30:
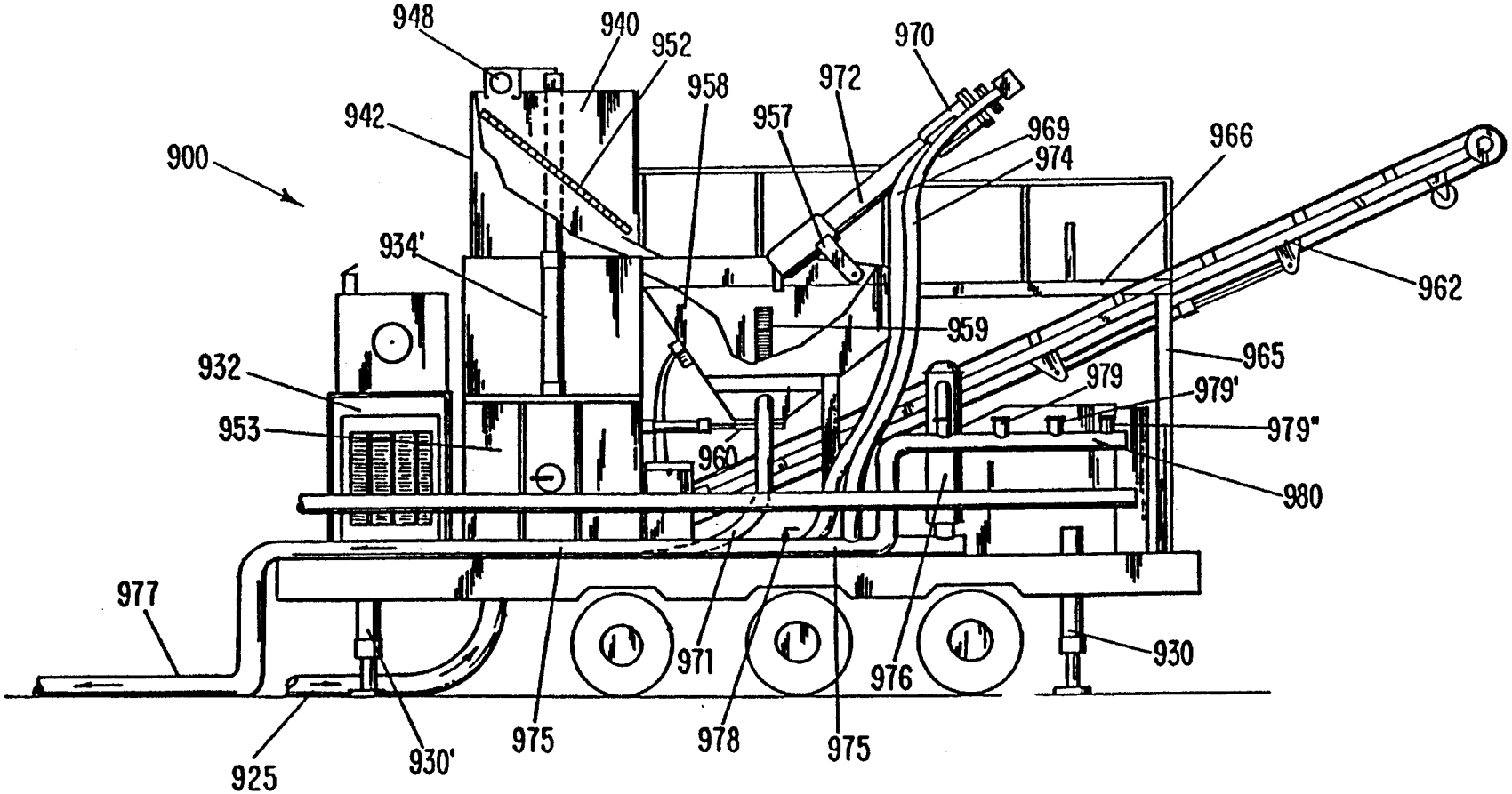
FIG. 30 is a left-side view of the embodiment of FIG. 29, with portions cut away to reveal an inclined screen within the separation unit and a filter drain within the hopper.
Figure 31:
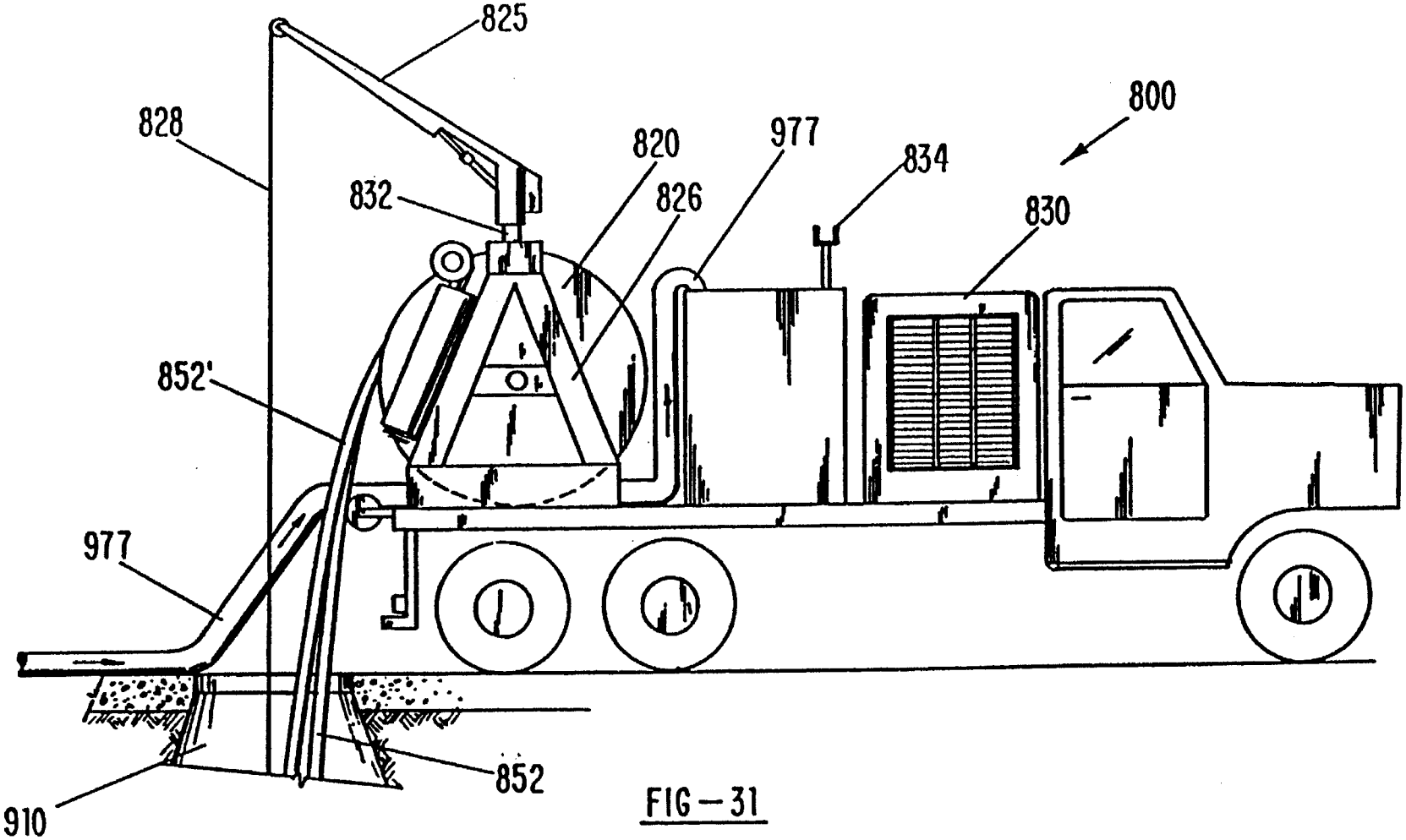
FIG. 31 is a side view of the preferred embodiment of the mobile power unit of the invention.

Reference is now made to FIG. 31, illustrating in some detail the preferred embodiment of power unit 800 for use with the preferred embodiment of the system (see FIG. 32). Mobile power unit 800 comprises a platform truck (e.g. 40') mounting a plurality of components necessary to the system operation. As stated, power unit 800 and separator and extraction unit 900 preferably are mounted upon a common vehicle, but alternatively may be disposed upon separate vehicles, as indicated in FIG. 30. Power unit 800 comprises a hydraulic hose reel 820 (e.g. 5') providing mechanized take-up and pay-out of pressure hoses 852,852', which are connected to cleaning module 850 (not shown in FIG. 31).

Power unit 800 also comprises crane 825 and withdrawal cable 828, providing for the raising and lowering of slurry pump 920 and/or cleaning module 850 in manhole 910. Crane 825 is equipped with winch (not shown) for reeling withdrawal cable 828. Hydraulic hose reel 820 and crane 825 preferably share a common A-frame support structure 826, and are powered from a platform-mounted internal combustion engine 830, preferably diesel. Hose reel 820 is fitted with common plumbing devices permitting pressure hoses 852,852' to convey liquids while being reeled/unreeled upon hose reel 820.

Power to hose reel 820 and crane 825 preferably is supplied by hydraulic motors (not shown), with internal combustion engine 830 serving as the power source, or alternatively by direct mechanical take-off from internal combustion engine 830 or alternatively electric motors. Also mounted upon power unit 800, and powered by engine 830, is a pump (not shown) to pump fluids, under pressure, through pressure hoses 852,852'. Crane 825 also preferably may be hydraulically raised and lowered, and may be pivoted about a vertical axle 832 in order to be lowered into storage rest 834 when not in use.

Figure 29:
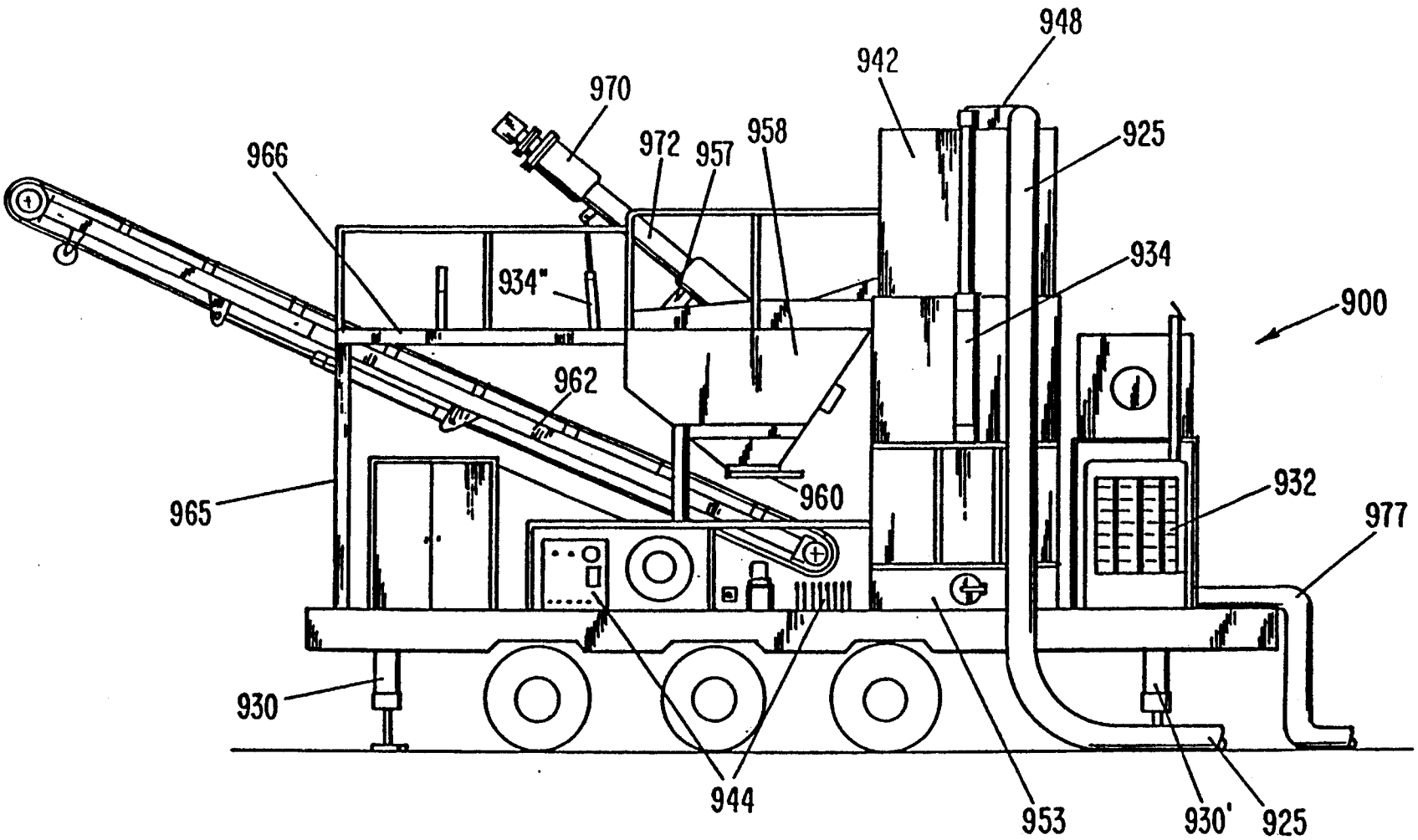
FIG. 29 is a right-side view of the preferred embodiment of the mobile extractor and separation unit of the invention.
Figure 33:
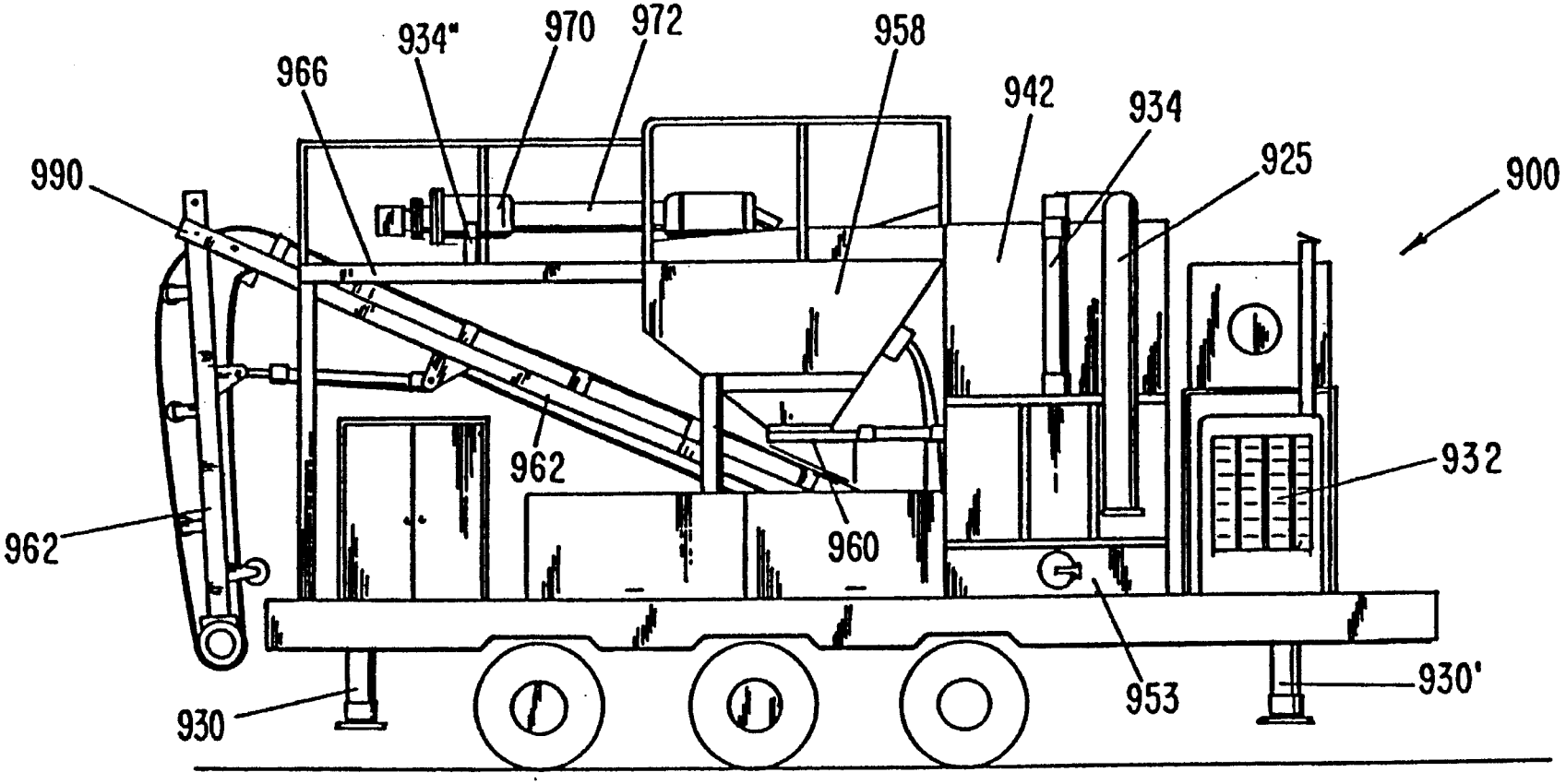
FIG. 33 is a side view of the embodiment of FIG. 29, showing the mobile extractor and separator unit in a collapsed configuration to facilitate transportation.

Reference now is made to FIGS. 29, 30 and 33, showing the preferred embodiment of extractor and separator unit 900. FIGS. 29 and 30 depict mobile extractor and separator unit 900 in the operating position. Extraction and separator unit 900 is equipped with hydraulic jacks 930,930', conventional in the field of heavy equipment, to provide additional support and stability during operation. A self-contained power source 932 comprising an internal combustion engine (preferably diesel) is provided to power the required hydraulic system, including the slurry pump 920 (FIG. 32), various hydraulic actuators 934,934',934", and the conveyor 962.

Operation of extractor and separator unit 900 is best illustrated with collective reference to FIGS. 29, 30 and 32. Unit 900 comprises a screening separator unit 940, which may comprise a Model W-600 ADF Wedge Water Sieve manufactured by Gravity Flow Systems, Inc. Other comparable water sieve separating systems may satisfactorily be used. Separator unit 940 is disposed within cradle 942. Separator cradle 942 is a hollow, telescoping framework, and is connected to hydraulic actuators 934,934'. Hydraulic actuators 934,934', which are controllable from control panel 944, provide elevational adjustment capability for cradle 942. As shown in FIG. 33, cradle 942 and separator unit 940 may be lowered when the unit is travelling en route to an operation destination.(in compliance with traffic regulations and to accommodate overpasses, etc.), to be raised when in operation. Vertical cradle guides (not shown in FIGS. 29–30) within cradle 942 stabilize and assure rectilinear vertical motion of cradle 942.

Reference is made to FIGS. 29, 30 and 32. In operation, separator unit 940 receives liquid, particulate and sludge wastes through slurry hose 925 and waste intake 948. Liquid and solid wastes are pumped from sewer line 10 through slurry hose 925 by the action of slurry pump 920, which is powered from internal combustion engine 932. As depicted in FIG. 32, the invention may comprise two separate internal combustion engines 830,932. In the preferred embodiment, however, all mechanized system operations may be powered from a single platform-mounted engine substituted for the pair of engines 830,932.

After agitation and flushing by cleaning module 850, liquid, particulate and sludge waste is pumped through slurry hose 925 and waste intake 948 into elevated separator 940. Liquid and suspended particulates fall through separator screen 952 (FIG. 30) and then drop into holding tank 953 directly below separator 940, while solids (sludges and some particulates) slide and tumble, by gravity, down inclined screen 952 and into hopper 958. Hopper 958 preferably is equipped with a bottom valve 960, controllable from control panel 944, for releasing contents of hopper 958 onto lower end of conveyor 962.

A ladder 965 to catwalk 966 with handrails permits ready access to separator unit 940 and screen 952. The separation through screen 952 of sludge waste from liquid and particulate waste may be readily observed from catwalk 966. When needed, the observer may direct an operator at control panel 944 to actuate flushing means (e.g., water spray, not shown) atop separator 940 to clear screen 952 with water spray action in the event of sludge back-up. Alternatively, an auxiliary control panel (not shown) may be located upon catwalk 966 to permit controlled operation of flushing mechanisms (and also conveyor 962 and bottom valve 960) from a position atop catwalk 966.

Liquid and particulate wastes fall through screen 952 and into holding tank 953. A pump (not shown) adjacent to holding tank 953 lifts liquid and particulate waste up through transfer line 969 (FIG. 30) to at least one cyclone or other separator 970 mounted above hopper 958. While only one separator 970 is illustrated, more than one cyclone separator 970 may advantageously be employed. Multiple separators preferably are connected in series. Alternatively, a plurality of separators may be connected in parallel. Likewise, other types of separators, common to the art, may be utilized. Cyclone separator 970 is fitted with hinge 957 and hydraulic actuator 934" to permit controlled raising and lowering of cyclone separator 970. In FIGS. 29, 30 and 32 cyclone separator 970 is depicted in the raised (operating) position; it may be lowered when not in use, as during transportation, as shown in FIG. 33.

Cyclone separator 970 receives and separates liquid waste from suspended particulate waste. Particulate waste moves by gravity down inclined conduit 972 and falls into hopper 958. Separated liquid waste—now nearly free of suspended particulates—is pumped from cyclone separator 970, through separator discharge line 974 (FIG. 30), to return pipe 975. If desired, valve 978 may be closed completely or partially to channel liquids, exiting separator discharge line 974, through filter line 980 to one or more washable filters 976, where final fine particulate removal is accomplished and the liquid waste returned to return pipe 975. One washable filter 976 is depicted in FIG. 30, but three additional filter junctions 979,979',979" are illustrated to show adaptability to up to e.g. four washable filters. Washable filters may inclued continuous-clean or self-purging filters known in the art.

Return pipe 975 is connected to return hose 977. The filtered liquid waste is pumped via return hose 977 to power unit 800 for reintroduction into pressure hose 852 and reuse through cleaning module 850. Additionally, liquid wastes incidentally accumulating in hopper 958 pass through fine filter drain 959 and flow through drain line 971 and into holding tank 953 (or, alternatively, into return pipe 975) for reuse in the system.

When substantial quantities of sludges and particulates have accumulated in hopper 958, bottom valve 960 (controlled from control panel 944) is opened as needed to allow measured quantities of solid wastes to fall onto conveyor 962. Because most liquid waste will have been removed from the sludge and particulates by cyclone separator 970, the solid waste (sludges and particulates) accumulating in hopper 958 will be in a semi-dry condition and will be manageable much like a thick mud or damp sand. A flexible curtain (e.g. rubber) may be suspended from hopper 958 to conveyor 962 to prevent backward or downward sliding of solid wastes from lower end of conveyor 962. As illustrated in FIGS. 29–30, conveyor 962 preferably is an inclined, typical continuous-belt conveyor; alternatively, it may comprise a tube-and-screw or other similar auger-type conveyor means, or the like. Sludge and particulate wastes are then moved by conveyor 962 to be deposited in a waiting dump truck, as shown in FIG. 32, for appropriate removal from the premises. The vertical position and operating velocity of conveyor 962 are controlled from control panel 944.

The vertical elevation of conveyor 962 may be adjusted using a standard hydraulic actuator (not shown). Additionally, conveyor 962 preferably has articulation joint 990, permitting it to be collapsed and lowered into a transportation position shown in FIG. 33.

An advantage of the invention is that solids separated and removed from the extracted slurry can be conveyed from the apparatus into a waiting truck, or other means of off-site transportation, without having to interrupt the cleaning process or relocate the extraction and separation unit. The independently mobile truck transports the collected solid waste to the appropriate disposal facility, while the extractor and separator unit, power unit, and cleaning module remain on-site to continue cleaning operations.

The general operation of the preferred system of the invention, and its advantages, can be appreciated with reference to FIG. 32. Mobile power unit 800 and mobile extractor and separator unit 900 are situated at manhole 910 downstream from line 10 to be cleaned. Crane 825 and cable 828 are used to lower slurry pump 920 down manhole to a position downstream of the line 10 to be cleaned. Cleaning module 850 is lowered down manhole 910, and aimed upstream. Slurry pump 920 is activated to pump liquid sewer wastes or slurry through slurry hose 925 to separator unit 940 in extractor and separator unit 900. Sludges in the slurry are separated from liquids and particulates in the separator unit 940, and then deposited in hopper 958. Liquids and particulates fall to holding tank 953 and are then pumped through cyclone separator 970, which separates particulates from liquids. Separated particulates fall into hopper 958. Liquid wastes are pumped and finally filtered through washable filter 976. Liquid wastes are pumped to power unit 800, and are then pumped under pressure through pressure hoses 852,852' to cleaning module 850. Liquids exiting module 850 continue downstream to slurry pump 920 where they are extracted and recirculated.

Particulates and sludges accumulate in hopper 958 until the user actuates bottom valve 960, allowing them to fall onto conveyor 962. Conveyor 962 is activated and operated at a controlled rate to transfer and deposit the sludges into a waiting receptacle.

The jet action of the liquid waste exiting cleaning module 850 propels module 850 forward through the line 10, while disturbing and flushing away accumulated sediments, scale and sludge. Agitated sediments, sludges and scale are washed downstream to slurry pump 920, where they are blocked by flow baffle 928 and together with sewage liquids are sucked into slurry hose 925, to begin a new cycle of extraction and separation. Hose reel 820 is controllably wound and unwound to manipulate the forward progress of module 850 and retrieve and withdraw it as necessary. An advantage of the invention is thus apparent. No or little water need be imported from off-site; rather, liquid wastes pre-existing in the line 10 are used, filtered, and repeatedly reused again as a cleaning agent and transport medium for sludges and particulates removed from the line 10.

Best results are achieved by releasing and retrieving module 850 at progressively longer intervals; for example, the user may allow module 850 to progress upstream 20', retrieve it, reintroduce it and allow it to clean 40' upstream, again retrieve it and reintroduce it, allow it to move 50' upstream and once again retrieve it, until the desired length of line 10 has been cleaned or the length of pressure hose 852 has been exhausted.

Figure 1:
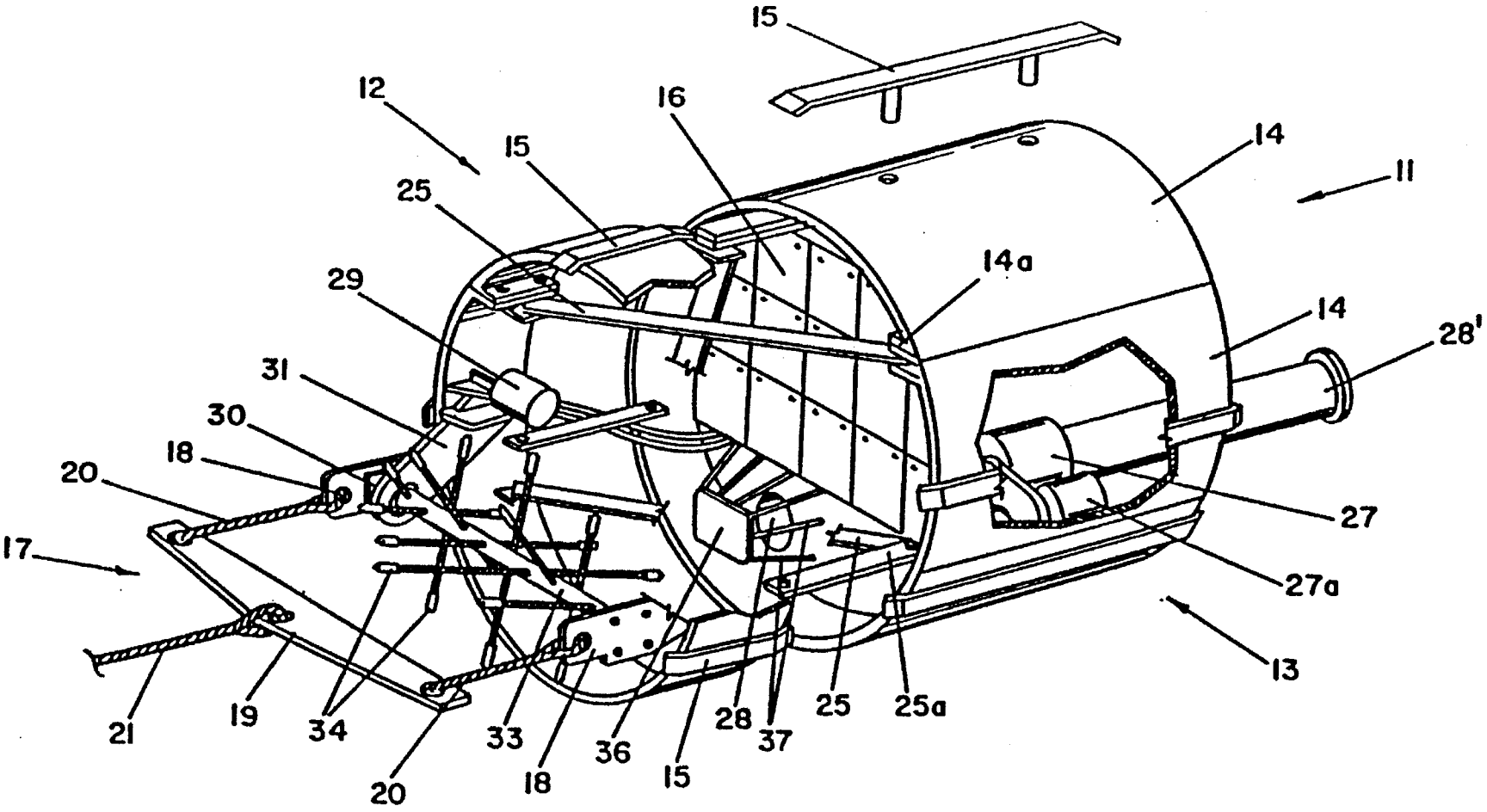
FIG. 1 is a perspective view of an alternative sewer cleaning module of the invention.
Figure 2:
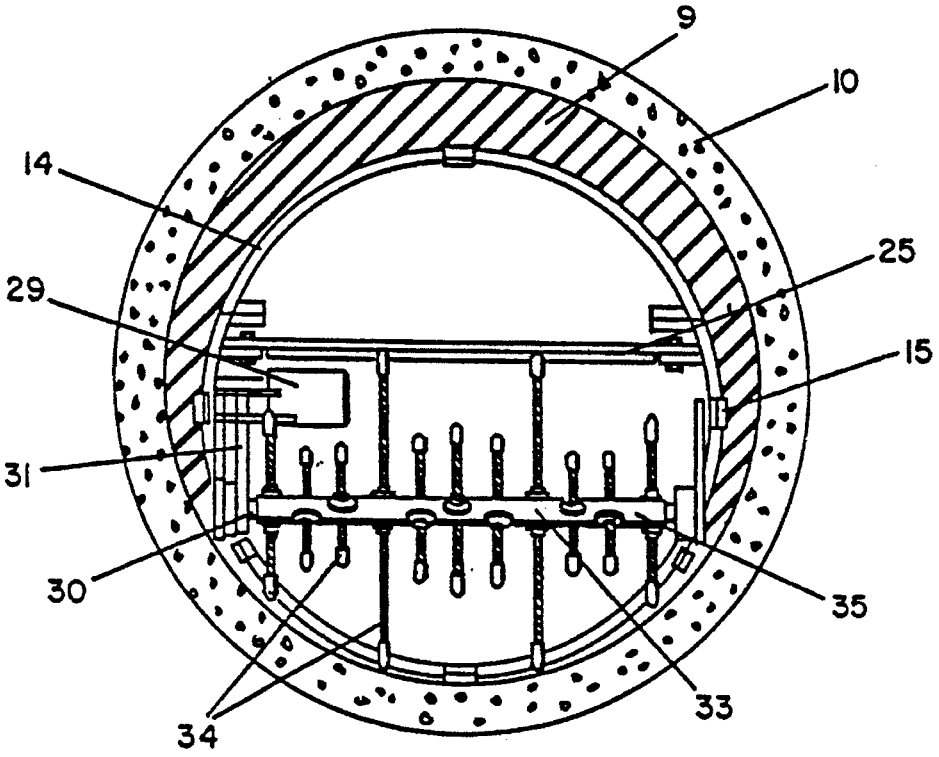
FIG. 2 is a front view of the embodiment of FIG. 1.
Figure 3:
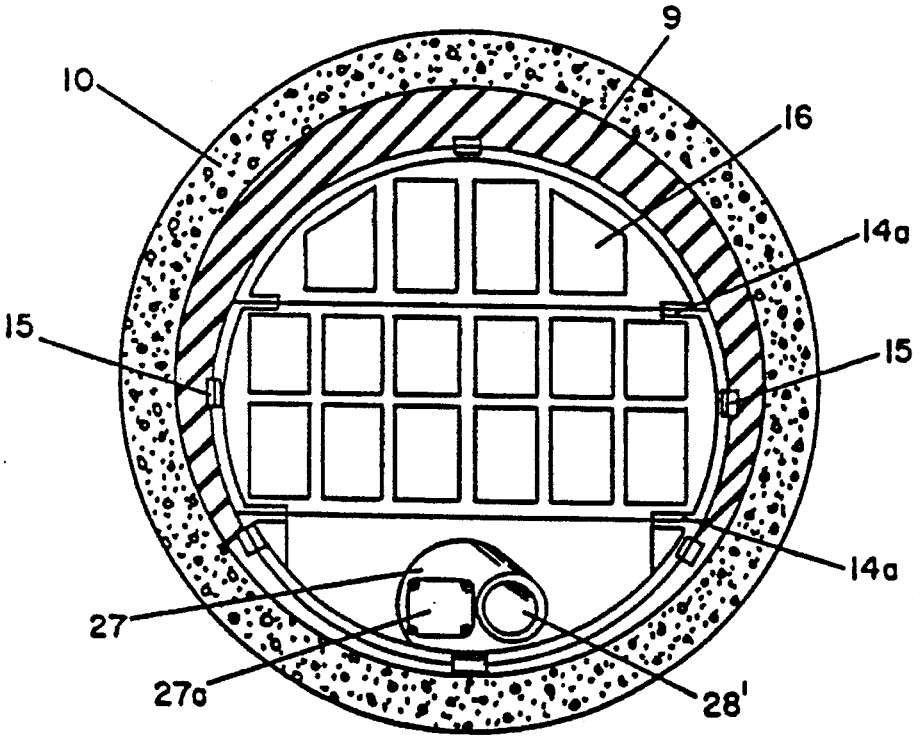
FIG. 3 is a rear view of the embodiment of FIG. 1.

Reference is made to FIGS. 1–3 of the drawings which show an alternative embodiment of the sewer cleaning module. As shown therein, sewer module 11 is depicted in an assembled state inserted in a sewer line 10 to be cleaned.

The alternative embodiment of sewer cleaning module 11 generally comprises a frame assembly, in turn comprising a forward unit 12 and a rear unit 13. Each unit comprises four arcuate segments 14: an upper segment, two center segments, and a lower segment. Arcuate segments 14 comprise flanges **14*a*, which are secured circumferentially by bolts or the like. Additionally, the segments have skids or runners 15 secured thereto by bolts or the like providing sliding support for module 11. A rubber shield 9 circumscribes the upper portion of rear unit 13, thereby providing a cushion against impact with sewer line 10**.

Arcuate segments 14 are normally assembled in situ in the sewer line. Radial dimensions and angular extent of segments 14 are governed by the diameter of the pipeline to be cleaned. For example, pipelines of 24", 36", and 48", respectively, would require arcuate segments 14 of differing radial dimensions. Angular arcuate extent, normally constant, could also be varied. Longitudinal extent of units 12 and 13 may also vary; normally, rear unit 13 is of greater length.

Units 12 and 13 are hingedly connected by hinge assembly 25. Hinge assembly 25 provides sewer module 11 with the capability of negotiating corners and curves in the pipeline. Hinge assembly 25 comprises flat steel bars or the like extending diagonally between units 12 and 13. Each end of the bars is pivotally connected to the internal flanges of segments 14, preferably by the segment securing bolts. Safety links **25*a* provide overall frame assembly integrity in the event hinge assembly 25** fails.

Sewer cleaning module 11 also comprises yoke 17 by which module 11 is drawn or towed through the pipeline. Yoke 17 comprises longitudinally extending tongues 18, welded or brazed to forward unit 12, mounting universal connecting members 20. Connecting members or cables 20 detachably engage crossbar 19 by hooking through apertures in crossbar 19. Towing cable 21 is fixedly attached to crossbar 19. The detachable connection of connecting members or cables 20 and crossbar 19 provides a quick connect-disconnect capability for sewer cleaning module 11.

In the alternative embodiment, tongues 18 rotatably mount output shaft 33 in bearings thereon. Output shaft 33, in addition to sprocket 30, mounts a plurality of wire rope or cable flails 34 thereon. Flails 34 are of variable length and diameter; both dimensions depend upon sewer pipe diameter. Normally the diameter of flails 34 is 1"; the length of flails 34 increases toward the center of sewer pipe be. Flails 34 are disposed in lines at staggered intervals (e.g., 60°) about shaft 33

Flails 34 are secured to shaft 33 by sleeves 35. Sleeves 35 are inserted in apertures in shaft 33, then welded or brazed to shaft 33. Flails 34 are inserted in sleeves 35 and secured thereto by screws or bolts. Mounting flails 34 in this manner provides rapid replacement of flails 34.

Output shaft 33 preferably is chain driven. Motor 29, mounted in forward unit 12, is operatively connected to sprocket 30 by chain 31. Preferably hydraulic, motor 29 may also comprise an electric or pneumatic motor. Rotation of shaft 33 is preferably clockwise, as viewed in FIG. 1; when activated, flails 34 churn, agitate, and otherwise disintegrate compacted sewage in sewer line 10 to particulate form. Particulate and liquid waste can then be dredged from sewer line (e.g., by suction).

Rear unit 13 comprises pump 27 hydraulically (or electrically or pneumatically) driven by motor 27*a* and connected to the power unit described above and to motor 29. Pump 27 is a centrifugal pump with "winglet" rotor providing suction for solid and liquid wastes through suction hose 28 (preferably 6" in diameter). Suction hose 28 also obtains suction from a booster pump aboard mobile power unit 500 (see FIGS. 13 and 14).

In this alternative embodiment of the cleaning module 11, rear unit 13 comprises flap valves 16 mounted about the forward end of rear unit 13. The valves are of sufficient number and strength to assure unidirectional flow (check valve operation). As shown in FIG. 1, flap valves 16 are fastened only at the forward end of rear unit 13; this readily permits downstream flow of sewage effluent by flexing or bending of the valves. Flow in the opposite direction is effectively blocked. Flap valves 16 are preferably constituted of tough, flexible, durable material, such as a reinforced plastic, hard rubber, or the like.

Rear unit 13 further comprises baffle 36 positioned over the entrance to discharge pipe 28'. Baffle 36 is supported by baffle rods 37 anchored to rear unit 13. Baffle 36 shields and deflects blocky solid waste from entering discharge pipe 28' while freely permitting entry of liquid and suspended particulate waste therein.

Figure 4:
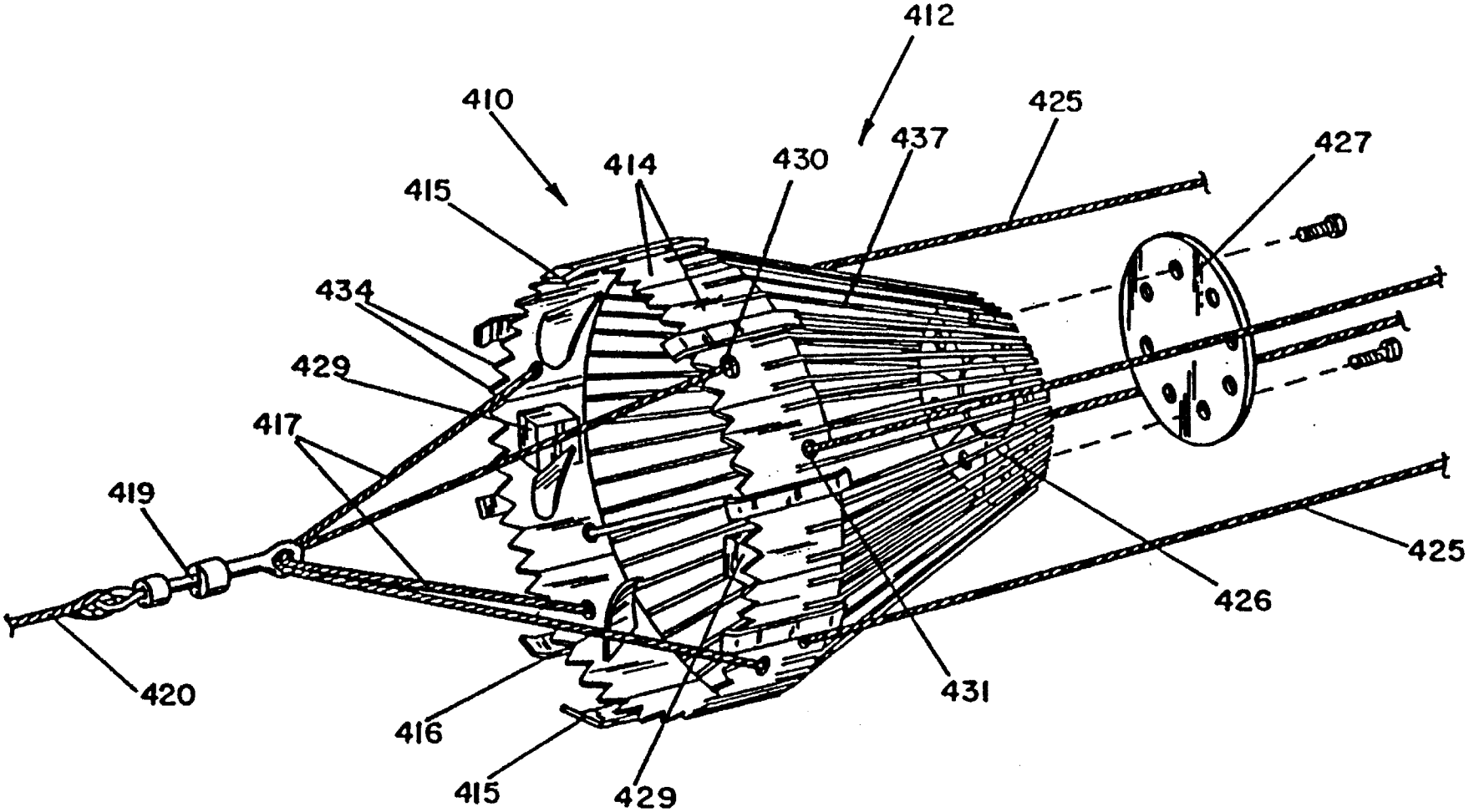
FIG. 4 is an alternate embodiment of a front unit of the embodiment of FIG. 1.
Figure 5:
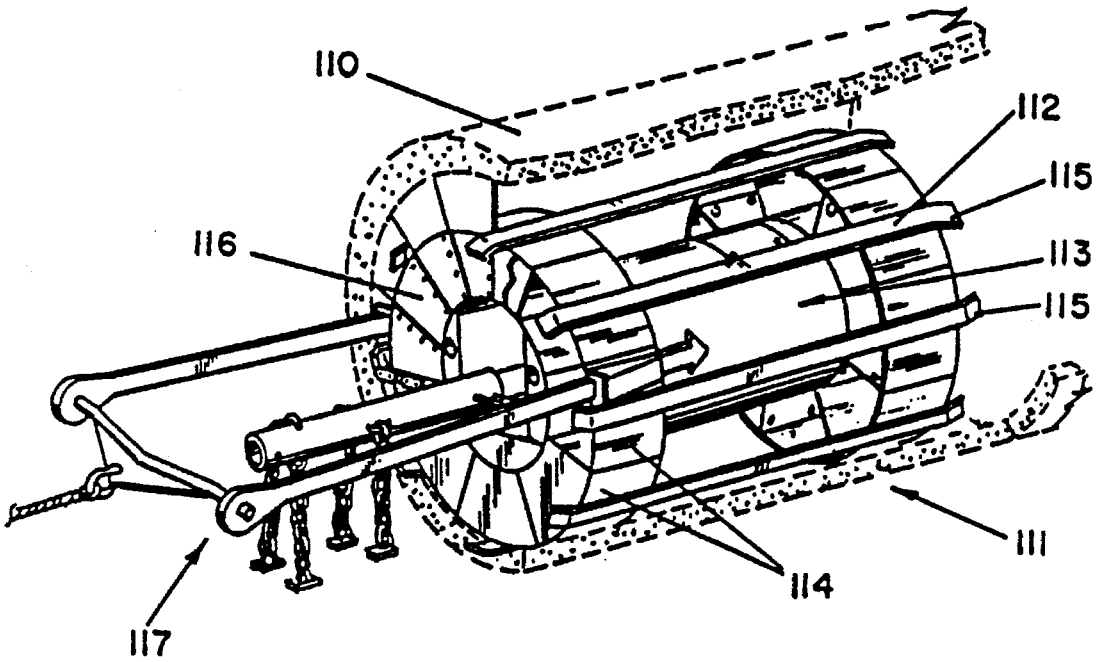
FIG. 5 is a perspective view of a second alternative embodiment of the sewer cleaning module.
Figure 6:
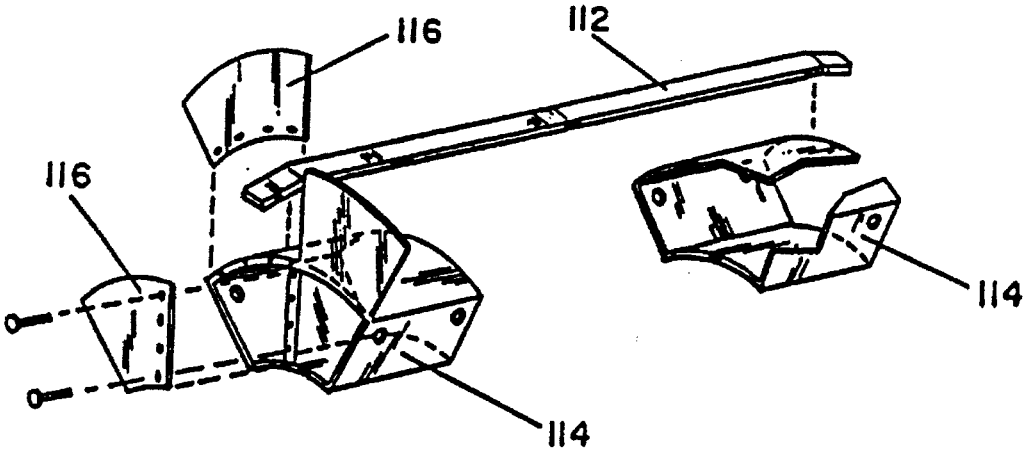
FIG. 6 is an expanded view of the support means and ribs of the FIG. 5 embodiment.
Figure 7:
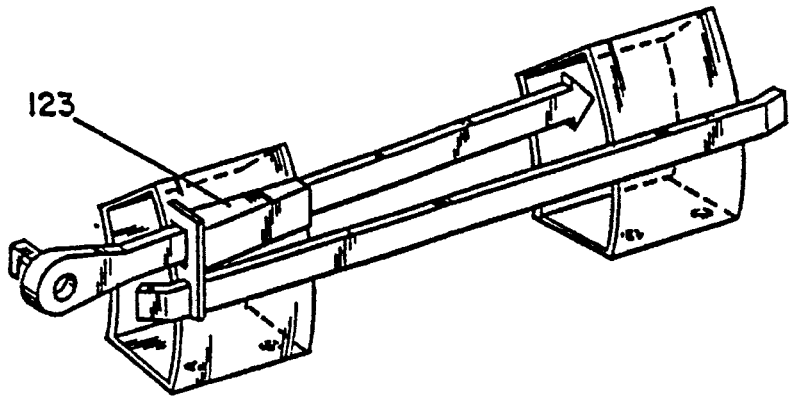
FIG. 7 is a perspective view of the yoke of the FIG. 5 embodiment.
Figure 8:
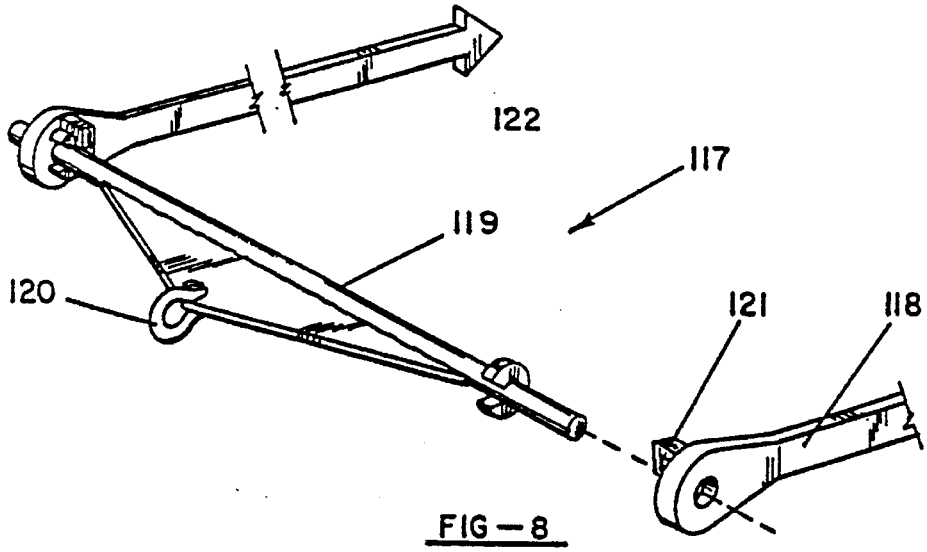
FIG. 8 is an exploded view of the yoke of the FIG. 5 embodiment.
Figure 9:
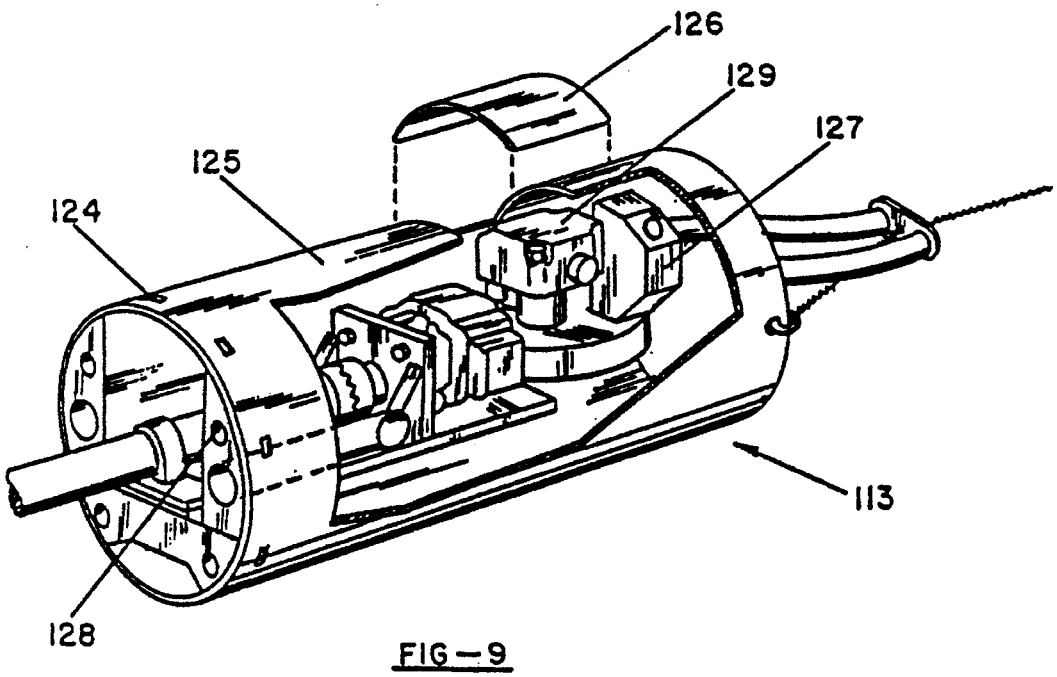
FIG. 9 is a cutaway view of the drive assembly of the FIG. 5 embodiment.

FIG. 4 depicts an alternative embodiment of forward unit 412 of sewer cleaning module 11. Forward unit 412 comprises annulus 410, in turn comprised by a plurality of toothed arcuate segments 414. Preferably eight in number, toothed arcuate segments 414 comprise a plurality of forwardly projecting teeth 434. Each segment 414 further comprises an axially extending skid or runner 415 providing reduced sliding friction between unit 412 and the walls of sewer line 10. Skids 415 are secured to the outer periphery of each arcuate segment 414 by welding, brazing, bolting, or the like. In like manner, fins 416 are secured to the inner surfaces of each arcuate segment 414 imparting a rotational motion component to forward unit 412, as well as stability.

Alternate arcuate segments 414 also comprise fore-and-aft staggered apertures 430, 431. Apertures 430 secure towing harness 417, while apertures 431 provide attachment for cables 425 secured to the rear unit 13 of sewer cleaning module 11.

Forward unit 412 further comprises a plurality of bars 437 (preferably steel) attached to annulus 420. Steel bars 437 extend rearwardly and downwardly and are attached to rear plate 426. Cover plate 427 is bolted or otherwise secured to rear plate 426. The resulting open cage structure permits free passage of sewage effluent.

Annulus 410 additionally comprises vibrators 429 diametrically and horizontally positioned within and mounted to annulus 410. Vibrators 429 may also be pneumatically or electrically powered; when energized, vibrators 429 agitate forward unit 412, thereby disintegrating, dispersing, and pulverizing compacted sewage.

Harness 417 is secured to tow cable 420 by swivel joint 419. Swivel joint 419 permits rotational motion of forward unit 412, thereby aiding in disintegration of solid waste.

Reference is now made to FIGS. 5–12 of the drawings which show a second alternative embodiment of the sewer cleaning module. As seen therein, sewer cleaning module 111 is also depicted in an assembled state inserted in a pipeline 110 to be cleaned. With specific reference to FIGS. 5 and 9, module 111 generally comprises frame assembly 112 and drive assembly 113 mounted coaxially within frame assembly 112.

In this second alternative embodiment, frame assembly 112 comprises a plurality of preformed segmental support members 114 interconnected by longitudinally extending ribs 115 by welding, brazing, or the like. In addition to providing longitudinal support, the bottom-most ribs 115 serve as skids or runners for the module. Segmental support members 114 are secured circumferentially by bolts or the like when assembling the sewer cleaning module, resulting in frame assembly 112 having a cylindrical configuration. Again, the radial dimension and angular extent of segmental support means 114 are governed by the diameter of the pipeline to be cleaned; for example, pipelines of 24", 36", and 48", respectively, would require segmental support members of differing radial dimensions and relative overall size. Angular extent, while normally constant, could also be varied. Frame assembly 112 could comprise eight units of segmental support members 114 joined by longitudinally extending members ribs 115; each such unit would comprise a pair of segmental support members 114 joined by a longitudinally extending rib 115. Assembly could occur after such units and other components had been lowered into a pipeline to be cleaned.

In this alternative embodiment, frame assembly 112 also comprises flap valves 116 mounted peripherally about one end of frame assembly 112. Flap valves 116 are fastened only at one side thereof to frame assembly 112; this readily permits downstream flow of sewage effluent by flexing or bending of the valves, but effectively blocks flow in the opposite direction.

Sewer cleaning module 111 also comprises yoke means 117 by which module 111 is drawn or towed through the pipeline. Yoke 117 further comprises slidable longitudinally extending tongue members 118, which detachably engage crossbar 119. Crossbar 119 includes towing cable attachment means 120, as well as locking mechanism 121 thereon. Tongues 118 are both slidably and pivotally mounted in lateral bearings 123, thereby facilitating engagement of crossbar 119 when assembling the module. Longitudinally extending tongues 118 are prevented from sliding through lateral bearings 123 by lugs 122.

Drive assembly 113 is coaxially mounted in frame assembly 112. With specific reference to FIG. 9, drive assembly 113 is preferably secured by slots 124 in slotted housing 125, engaging corresponding projections in frame assembly 112. Slotted housing 125 also has an access port 126 and vents (not shown) at the other end thereof.

Drive assembly 113 includes pump 127. Pump 127 directs liquid sewage through hoses at high velocity, exiting through nozzles 128. Preferably four in number, nozzles 128 aid in generating and liquefying a sewage slurry.

Figure 10:
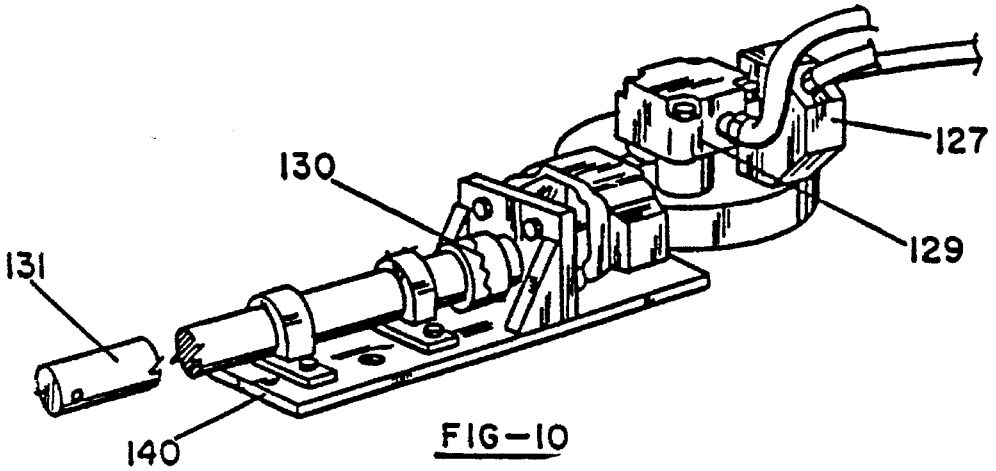
FIG. 10 is a perspective view of the drive of the FIG. 5 embodiment.
Figure 11:
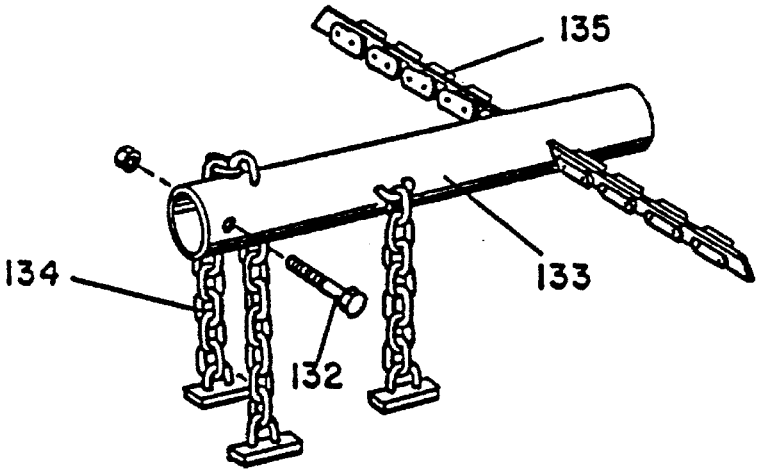
FIG. 11 is a perspective view of the output shaft of the FIG. 5 embodiment.

With specific reference to FIGS. 10 and 11, drive assembly 113 also includes motor 129, mounted therein by motor mount 140. Preferably hydraulic, motor 129 may also be an electric or pneumatic motor (not shown). Motor 129 is operatively connected to shaft 131 by gears 130. Shaft 131 is in turn connected to concentrically mounted output shaft 133 by shear pin 132.

Output shaft 133 includes flails 134 and impeller 135 mounted thereon. Flails 134, preferably lengths of chain with rectangular steel blocks secured thereto, are each preferably of a length less than the radius of pipeline 110 to avoid possible contact and damage to the pipeline. Impeller 135 is hingedly connected to output shaft 133, folding backwardly upon encountering an obstruction. In the alternative embodiment, sewer cleaning module 111 generates and propels a sewage slurry forwardly of such module. Flails 134, nozzles 128, and impellers 135 agitate, liquefy, and propel the slurry downstream of module 111. The generation and propelling of such slurry not only drives the sediment and sewage load forward, but also scours and removes scale deposits from the pipeline walls by cavitation and abrasive action alone. Flails 134 preferably do not contact the pipeline walls.

In a further alternative embodiment, a plurality of cutter means (not shown) are mounted on frame assembly 12 proximate flap valves 16. Cutter blades are mounted on output shaft 133 in lieu of impeller 135. When activated, these cutter blades, together with the stationary cutter blades on frame assembly 112, and nozzles 128 are operative to generate a sewage slurry by "chopping" or rending the sewage. The slurry thus generated is propelled rearwardly of sewer cleaning module 111 by suction from the mobile power unit 500 (see FIGS. 13 and 14).

Figure 12:
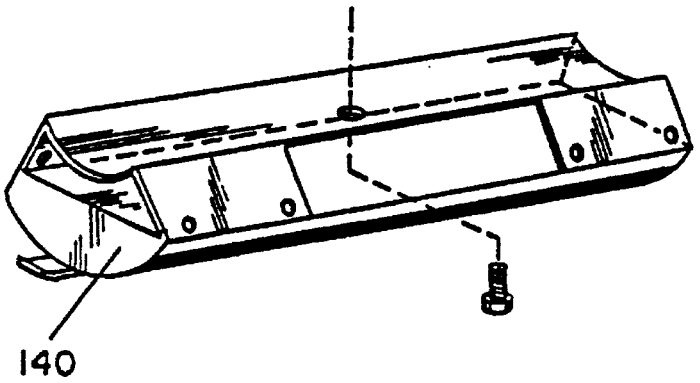
FIG. 12 is an isolated view of ballast means in the bottommost portion of the frame assembly of the FIG. 5 embodiment.

With reference to FIG. 12, ballasting 140 is provided in the bottom-most portion of the frame assembly to assure eccentric positioning of the shaft means relative to the pipeline. Lead, lead alloys, or other suitable metal could be used.

As can be appreciated by those skilled in the art, the frame configuration and other components can be modified to accommodate varying shapes of pipes, conduit, channels, and the like. The invention is not limited to the cylindrical embodiments shown therein.

Figure 13:
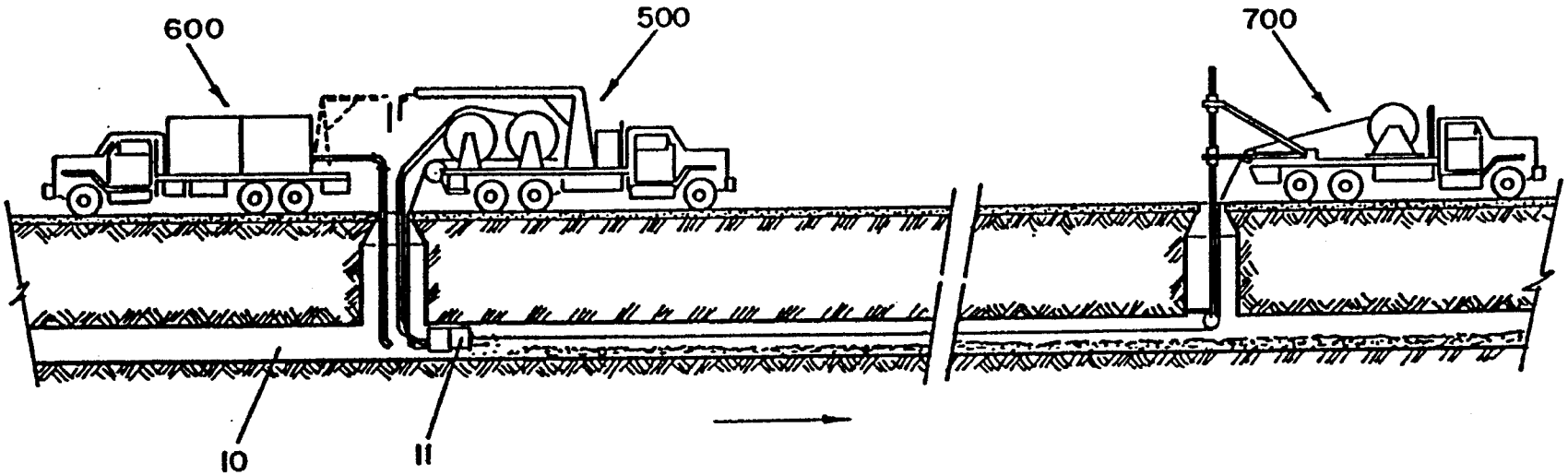
FIG. 13 is a side view of an alternative sewer cleaning system of the invention.

With specific reference to FIG. 13, an alternative embodiment of a system for cleaning a sewage line section comprises, in combination, mobile power unit 500, sewer cleaning module 11, mobile extraction and separation unit 600, and mobile towing unit 700. In this alternative embodiment of the system, all units are mobile and are positioned over and along a sewage line section 10 to be cleaned. Although the discussion of this sewer system pertains to the first alternative sewer cleaning module 11, it is also applicable to the second alternative sewer cleaning modules 111, and other sewer cleaning devices.

In this alternative embodiment of the system, extraction and separation unit 600,600' is sited upstream proximate mobile power unit 500 which provides suction rearwardly of the sewer cleaning module. Mobile towing unit 700 is sited downstream.

Figure 14:
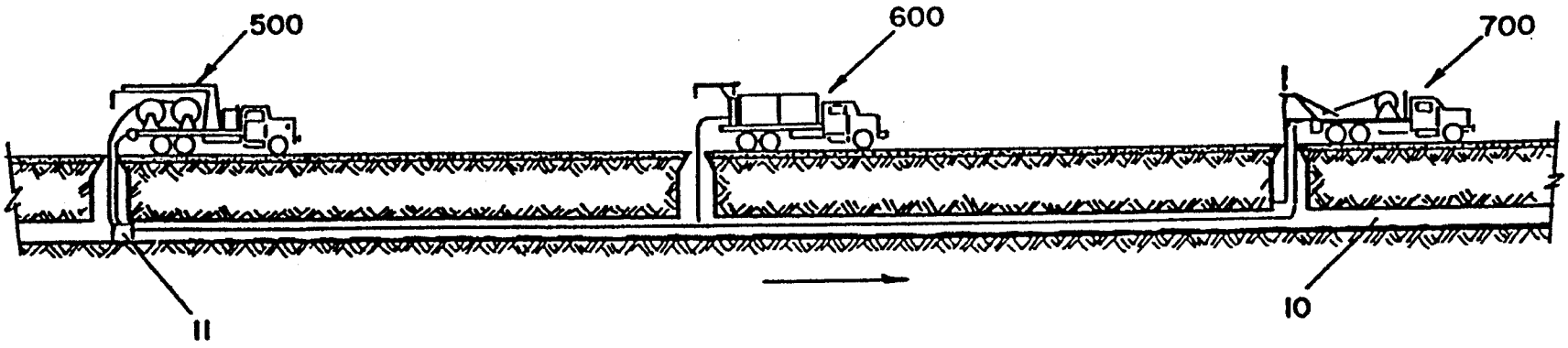
FIG. 14 is a side view of another alternative embodiment of the sewer cleaning system of the invention.

In a second alternative embodiment of the system, shown in FIG. 14, power unit 500 and sewer cleaning module components are sited furthest upstream, towing unit 700 is sited furthest downstream, and extraction and separation unit 600,600' is sited intermediate the power unit 500 and towing unit 700.

Sewer cleaning module 11 components are lowered into the sewage line. Sewer cleaning module 11 is then assembled and connected to towing unit 700 and power unit 500. Power is provided to sewer cleaning module 11 simultaneously while towing the module through the sewage line section 10 at a rate commensurate with sediment load, amount of scale deposit, degree of compaction, and total volume of sewage.

As shown is FIG. 13, an alternative embodiment of mobile power unit 500 comprises a platform truck (e.g., 28') mounting a plurality of components necessary to system operation. Mounted rearmost on the platform is a power winch wound with cable (e.g., ½" cable). This cable is attached to the rear of the sewer cleaning module as a safety tether.

In this alternative embodiment, mobile power unit 500 further comprises two hydraulic hose reels (e.g., 4½') providing hydraulic supply and return lines to sewer cleaning module 11.

Mobile power unit 500 also comprises a reel (e.g., 10') mounting discharge hose (e.g., 6" diameter). The booster pump aboard mobile power unit 500, coupled with the discharge hose, assists in transporting solid and liquid waste from sewer cleaning module 11 to mobile extractor and separator unit 600,600'.

Mobile power unit 500 further comprises a self-contained hydraulic power unit comprising an internal combustion (IC) engine, preferably diesel, together with requisite fuel tanks.

In this alternative embodiment, power unit 500 supplies open- or closed-ended hydraulic power to sewer cleaning module 11; alternatively, electric or pneumatic power could also be supplied. Preferably also, power unit 500 comprises appropriate control mechanisms for determining the speed and torque of motor 29 in sewer cleaning module 11.

Figure 15:
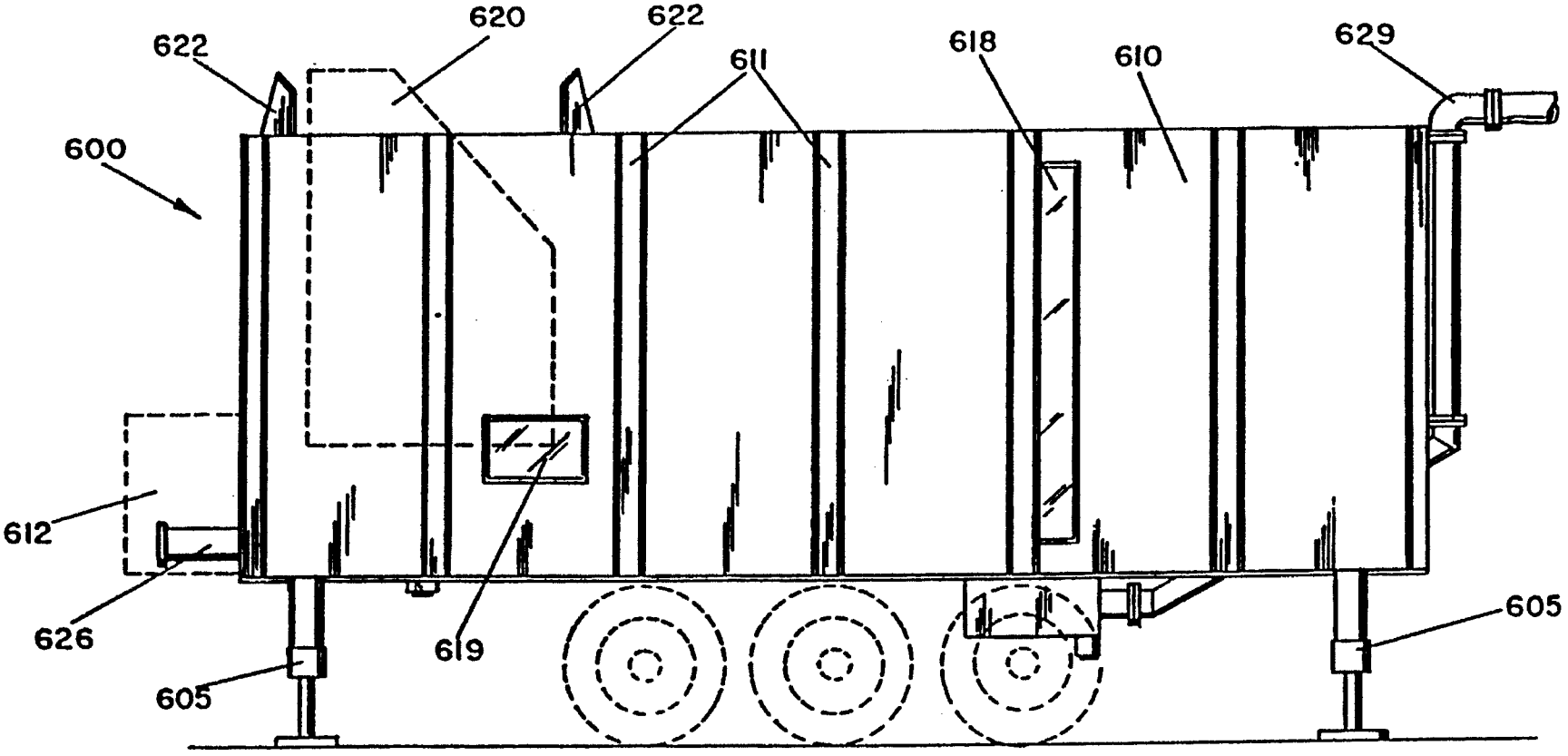
FIG. 15 is a side view of the mobile extractor and separator unit of the FIG. 13 and 14 embodiments.
Figure 16:
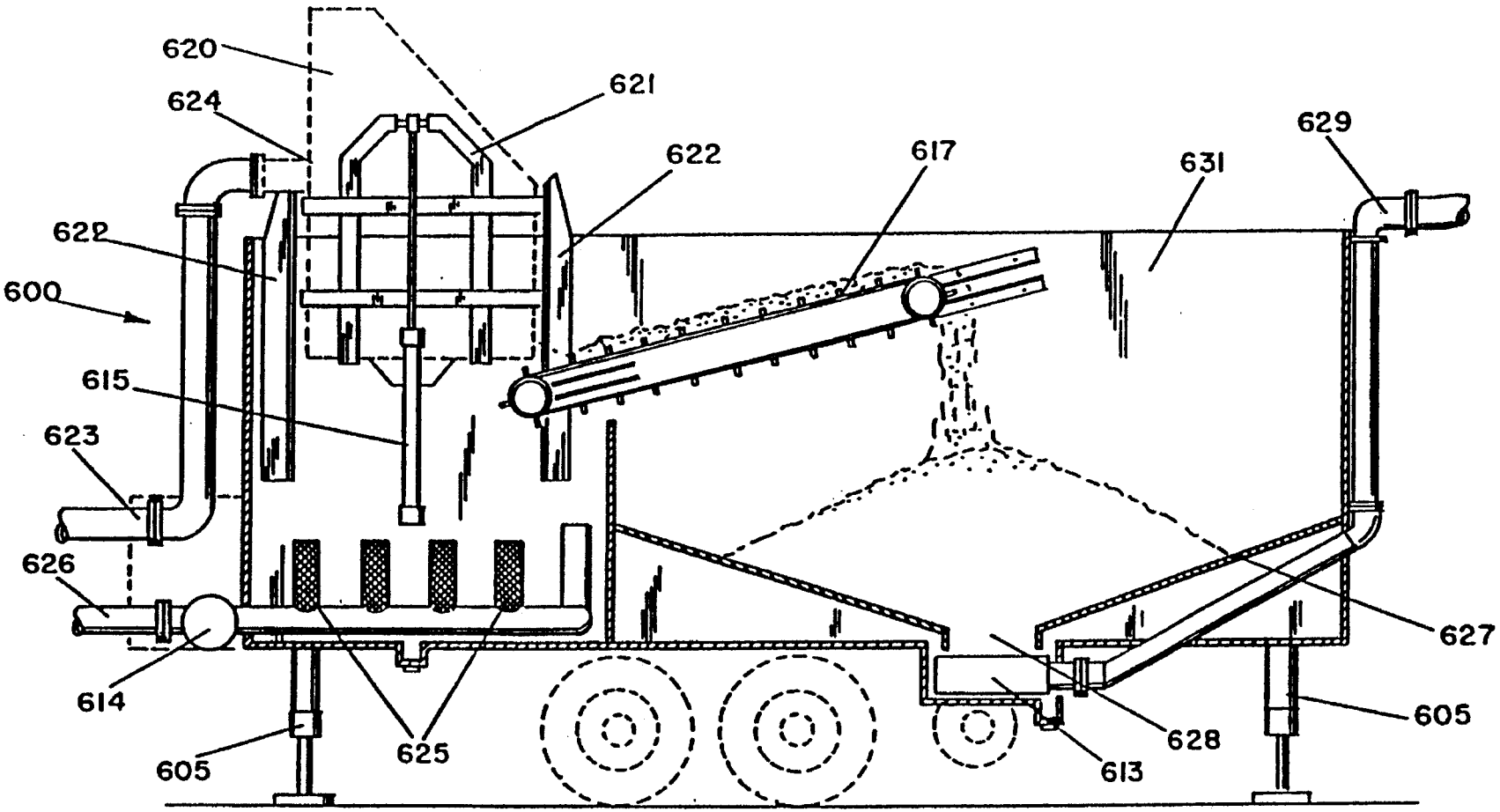
FIG. 16 is a side cross-sectional view of the FIG. 15 embodiment.
Figure 23:
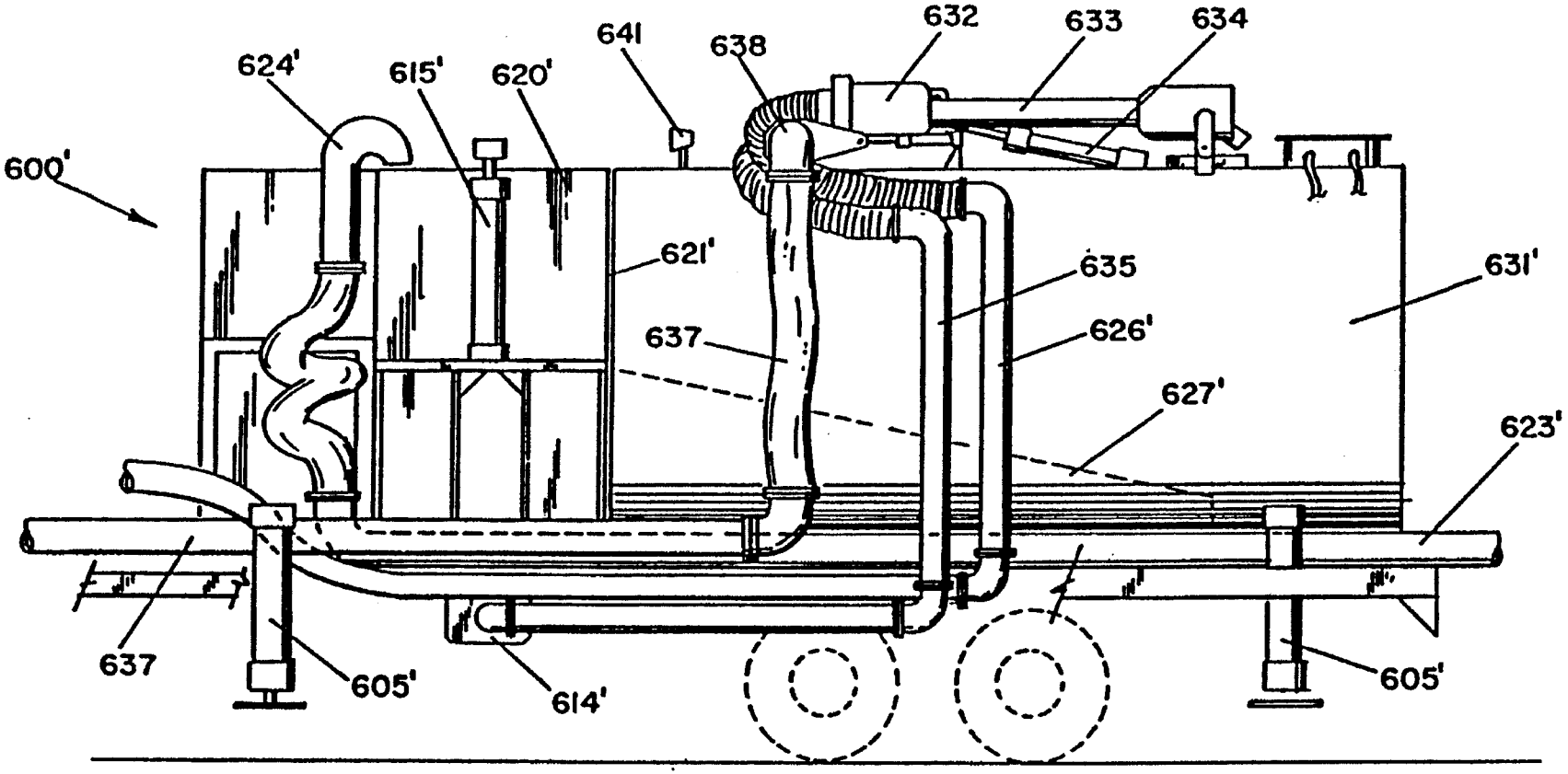
FIG. 23 is a side view of the mobile extractor and separator unit of the alternative embodiment of the invention.
Figure 24:
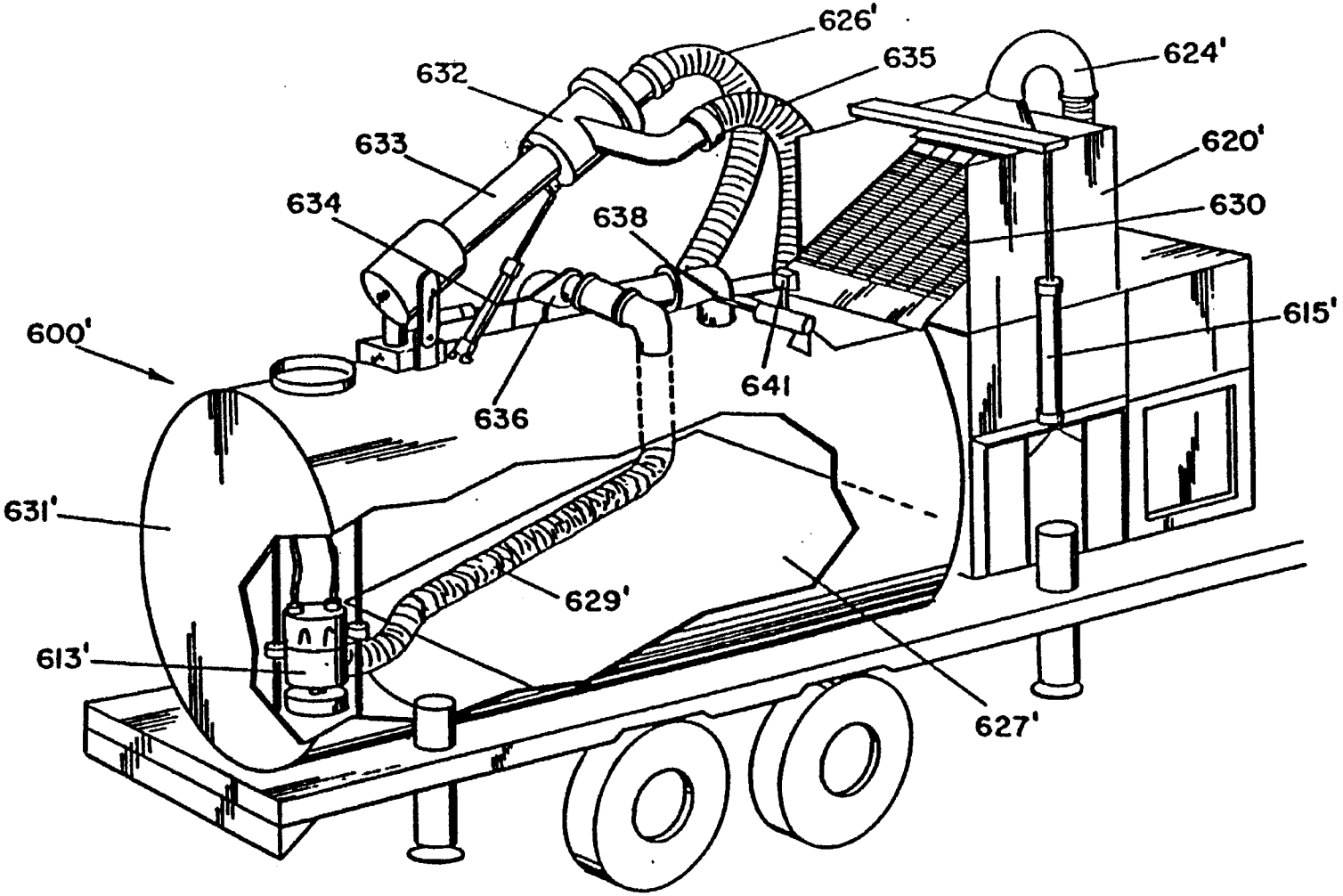
FIG. 24 is a perspective cutaway view of the FIG. 23 embodiment.

Reference is now made to FIGS. 15 and 16, which illustrate an alternative embodiment of the mobile extractor and separator 600, and FIGS. 23 and 24, which illustrate this embodiment of the mobile extractor and separator 600' of the invention.

FIGS. 15 and 16 depict mobile extractor and separator unit 600 in the operating position. Mobile extractor and separator unit 600 is provided with hydraulic jacks 605 to provide the additional support necessary to support up to, e.g., 100,000 pounds of raw sewage. Lateral support for walls 610 of unit 600 is provided by reinforcing channels 611. A self-contained power unit 612 comprising an internal combustion (IC) engine (preferably diesel) is provided to power the required hydraulic system, including pumps 613, 614, hydraulic actuators 615, and conveyor 617. Viewing windows 618 and 619 are provided in walls 610 to observe operation and detect any malfunctioning of unit 600.

Operation of mobile extractor and separator unit 600 is illustrated in FIG. 16. Unit 600 comprises separator unit 620, which may comprise a Model W-600 ADF Wedge Water Sieve manufactured by Gravity Flow Systems, Inc.; other comparable separator systems may also be used. Separator unit 620 is removably nested within cradle 621. Cradle 621 comprises an open framework structure connected to hydraulic actuators 615. Hydraulic actuators provide an elevational capability for cradle 621 and separator unit 620; cradle 621 and separator unit 620 are normally lowered when travelling and raised when in operation. Cradle guides 622 journal cradle 621 and assure rectilinear vertical motion of cradle 621.

In operation, elevated separator unit 620 receives liquid and solid waste through intake pipe 623 and waste intake 624. The liquid and solid waste is pumped from sewer cleaning module 11 and additional pumping capacity is furnished by the booster pump aboard mobile power unit 500. Separator unit 620 separates liquid from solid waste; liquid waste falls through screened drains 625 into liquid discharge manifold 626. Conveyor 617 conveys solid waste to hopper 631. Liquid waste is returned to the sewer line by pump 614 and liquid discharge manifold 626.

Hopper 631 comprises angled sides 627 sloping downwardly to drainhole 628. Pump 613 pumps the solid waste through solid waste discharge pipe 629 to a tanker truck, dump truck, hopper car, or the like, for removal.

Reference is now made to FIGS. 23 and 24, which also illustrate this alternative embodiment of the present invention.

FIGS. 23 and 24 depict mobile extractor and separator unit 600' in the operating position. Liquid, particulate and solid waste is pumped through intake pipe 623' and waste intake 624' into elevated separator 620', or any acceptable substitute therefor. Liquid and particulate waste fall through screen 630, while sludge waste drops onto incline 627' and settles towards pump 613' in hopper or receptacle 631' by force of gravity. A conveyor is not utilized in this embodiment.

A television camera 641 mounted atop separator 620 records the separation of sludge waste from liquid and particulate waste, and transmits the image to a monitor (not shown). An operator at the monitor or mobile power unit 500 may then actuate flushing means (e.g., water spray) atop separator 620 to clear the screen with water spray action in the event of sludge back-up. Alternatively, sludge back-up could be signalled by limit switches or other proximity sensors, and the flushing means thereby be automatically actuated.

Liquid and particulate waste falls through screened drains below separator 620' into a manifold. Pump 614' pumps liquid and particulate waste through conduit 635 up to cyclone separator 632 mounted on drain pipe 633. Drain pipe 633 also comprises hydraulic actuator 634 by which it is raised and lowered.

Cyclone separator 632 receives and separates liquid waste from particulate waste. Particulate waste settles down inclined drain pipe 633 by force of gravity and falls into hopper or receptacle 631'. Liquid waste is returned to the sewer line through conduit 626'.

Pump 613' in hopper or receptacle 631' pumps accumulated sludge and particulate waste through flexible conduit 629', valve 636, and discharge pipe 637 into a hopper car, dump truck, and the like for removal. Valve 638 remains closed during this operation.

If removal vehicles are not immediately available for sludge and particulate waste removal, valve 638 is opened and valve 636 is closed. Opening of valve 638 permits continuous circulation of sludge and particulate waste through hopper 631', flexible conduit 629', valve 638, and back to hopper 631'. Such circulation serves to keep the sludge and particulate waste relatively fluent while awaiting removal. Valves 638 and 636 are mutually exclusive in operation: closure of valve 638 occurs simultaneously with opening of valve 636 and vice versa.

All pumps and actuators are hydraulically powered. Mobile extractor and separator unit 600' may carry its own IC prime mover, in addition to receiving power from mobile power unit 500.

Figure 17:
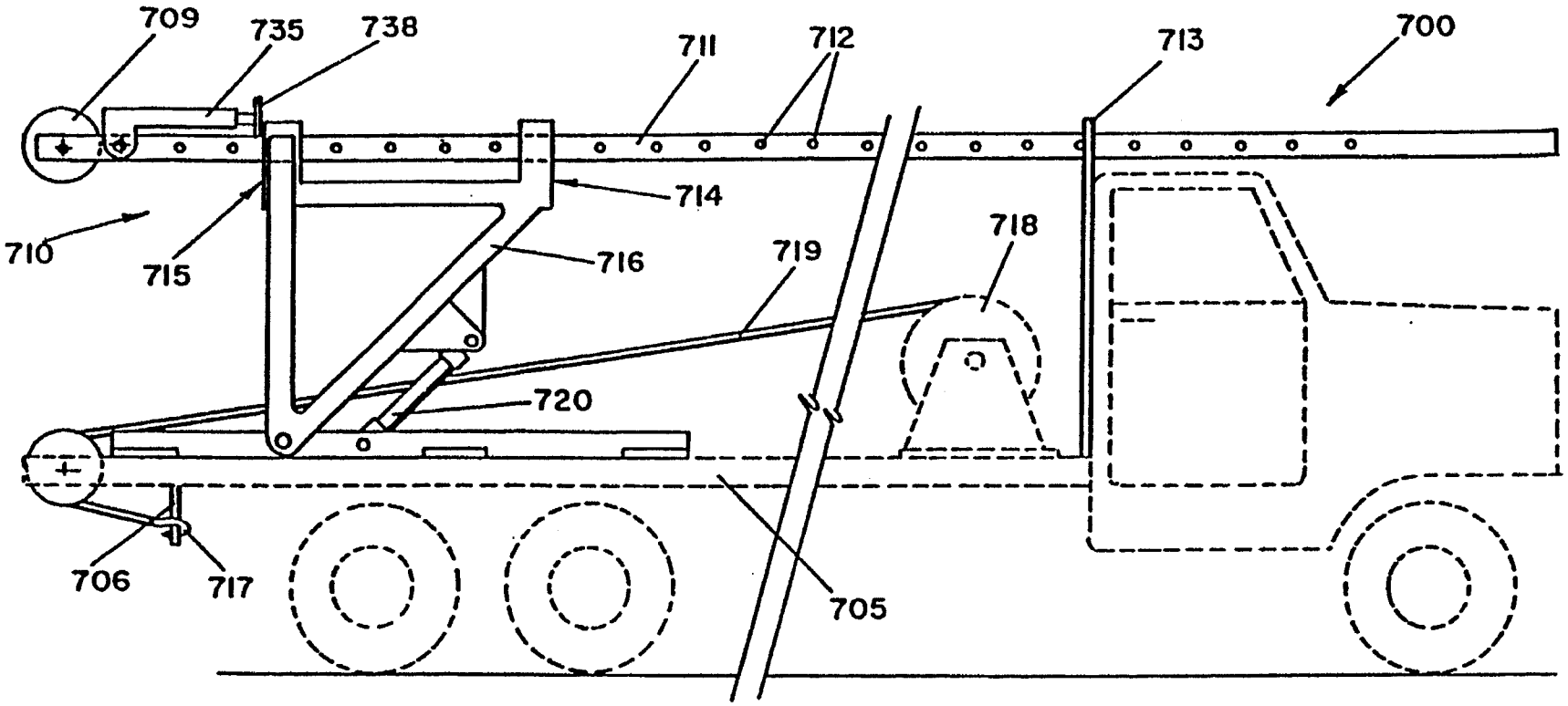
FIG. 17 is a side view the mobile towing unit of the FIG. 13 and 14 embodiments in travelling position.

FIG. 17 shows downhole boom 710 in the travelling position aboard mobile towing unit 700. Downhole boom 710 preferably comprises a suitable length of hollow square pipe 711 having a plurality of apertures 712 on opposed sides thereof. While travelling, the top portion of square pipe 711 is secured to and supported by cradle 713. The bottom portion of square pipe 711 is secured to and supported by upper and lower bearings 714, 715 mounted on bracket 716. Locking pins through apertures 712 secure and maintain square pipe 711 stationary while travelling.

Towing hook 717 is grappled to bar 706 projecting downwardly from truck bed 705. Appropriate tension is applied by winch 718 to assure cable 719 remains taut while travelling.

Figure 18:
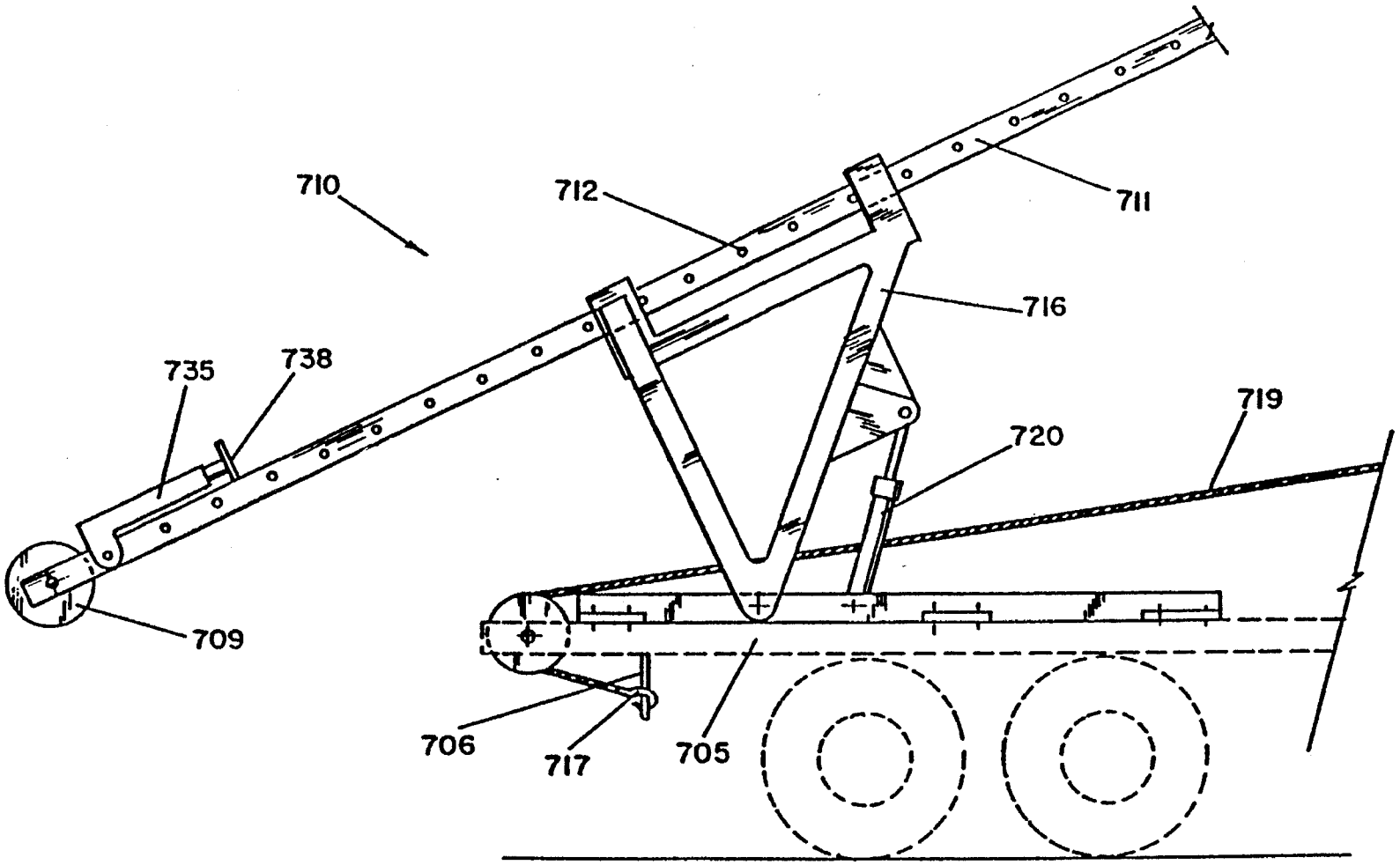
FIG. 18 is a side view of the FIG. 17 embodiment partially extended.
Figure 19:
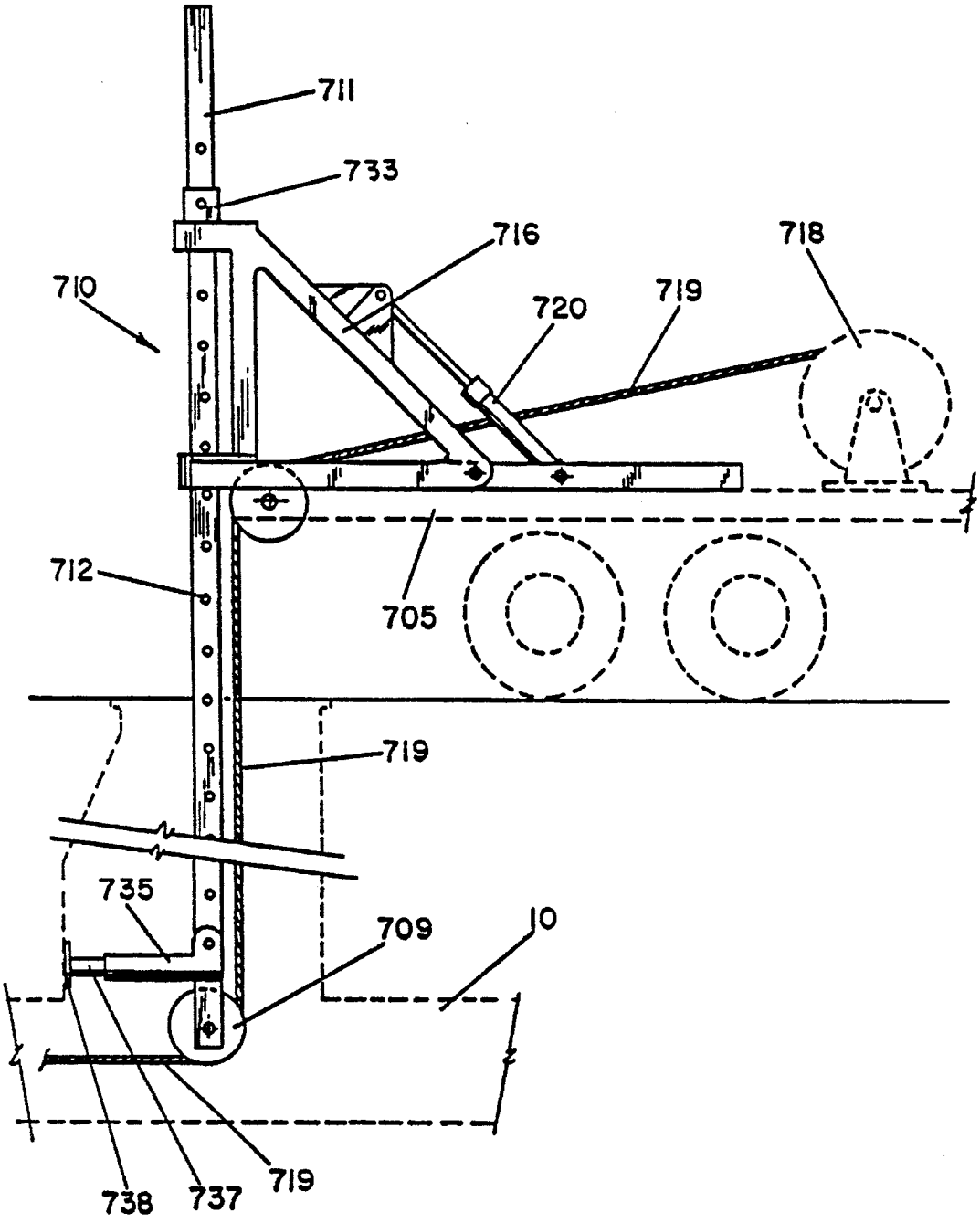
FIG. 19 is a side view of the FIG. 17 embodiment in its operating position.

Prior to extension and lowering downhole boom 710 into a selected manhole, the top portion of square pipe 711 is released from cradle 713. Hydraulic pressure is applied to hydraulic actuators 720, rotating bracket 716 and downhole boom 710 counterclockwise, as viewed in FIG. 18. Continued rotation, as depicted in FIG. 19, brings downhole boom 710 to the erect or operating position. Bracket 716 then abuts truck bed 705, providing support.

Figure 20:
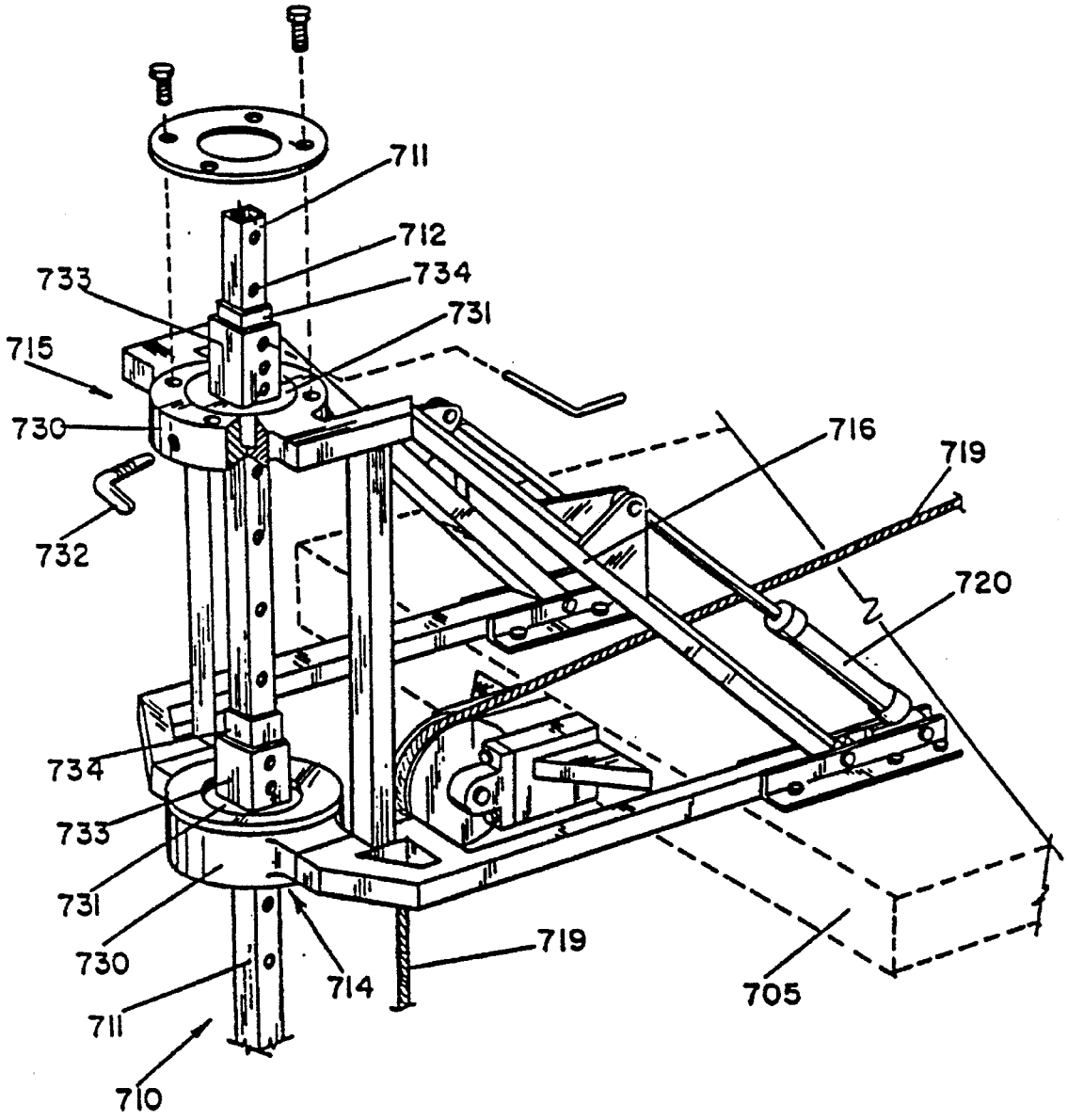
FIG. 20 is a cutaway perspective view of the FIG. 17 embodiment.

Upper and lower bearings, as shown in FIG. 20, provide rotational and lengthwise adjustment, as well as support, for square pipe 711. Each bearing comprises an annulus 730 fixed by welding, brazing, or the like, to bracket 716. Annulus 730 circumscribes relatively rotatable annular segment 731. Annulus 730 and rotatable annular segment 731 provide adjustment of the rotational attitude of square pipe 711. Threaded locking handle 732 secures annulus 730 and rotatable annular segment 731 against further rotation when the predetermined rotational attitude of square pipe 711 is attained by rotation of rotational annular segment.

Each rotatable annular segment 731 further surrounds and is fixedly secured to stationary square pipe bushing 733. Bushing 733 is apertured and freely permits longitudinal movement of square pipe 711 therethrough for lengthwise adjustment. Movement of square pipe 711 through bushing 733 is facilitated by sleeve 734, preferably made of plastic. Plastic sleeve 734 is fixed to square pipe 711 and extends a predetermined distance above and below each bearing 714, 715. Plastic sleeve 734 reduces sliding friction between pipe 711 and bushing 733, thereby eliminating the need for further lubrication. When the appropriate downhole length of square pipe 711 is reached, locking pins through the apertures of bushing 733 and square pipe 711 prevent further lengthwise displacement of square pipe 711.

Figure 21:
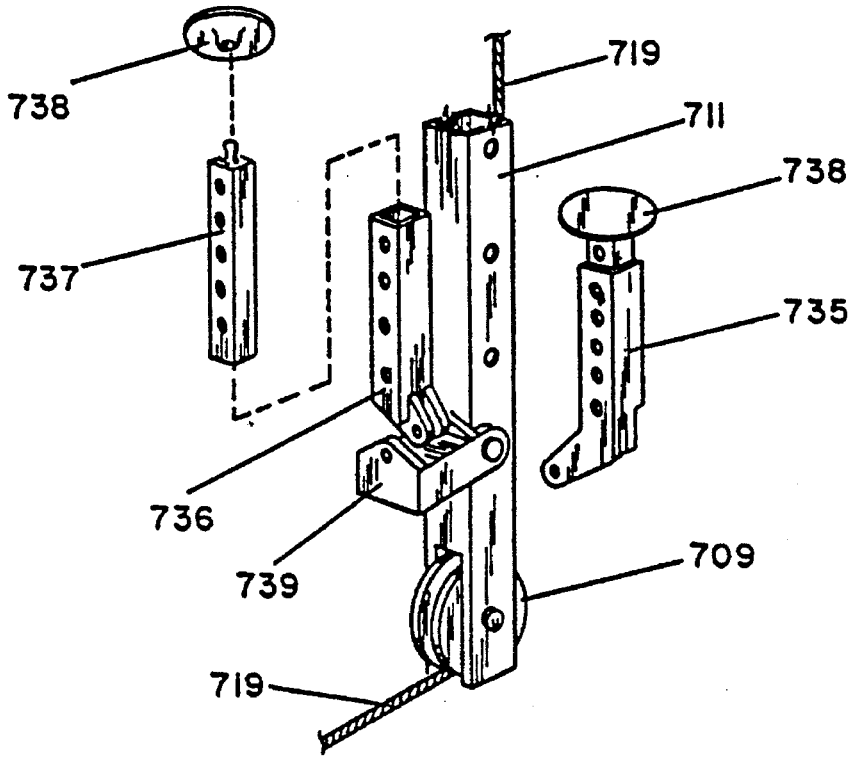
FIG. 21 is a perspective view of the braces of the alternative embodiments in retracted position.
Figure 22:
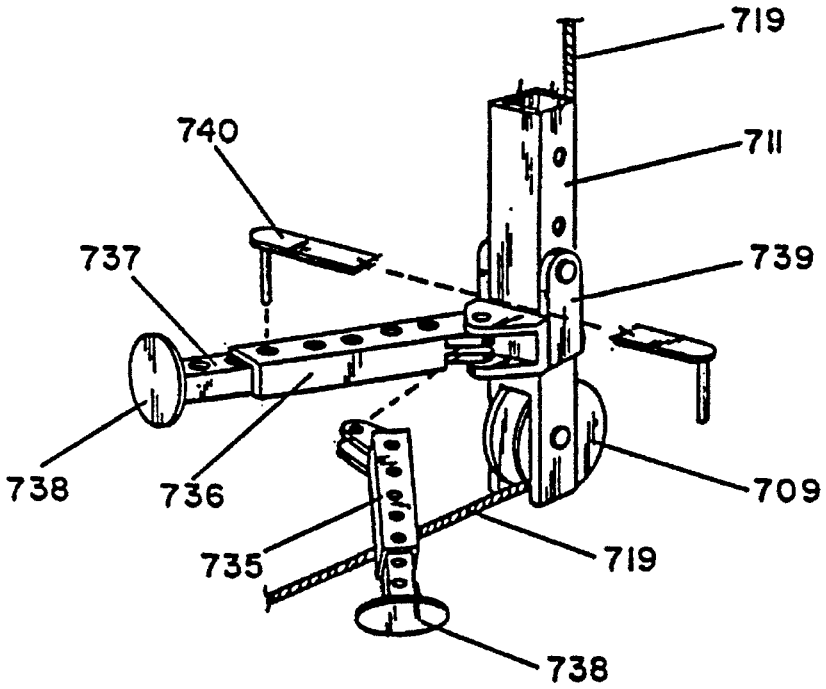
FIG. 22 is a perspective view of the braces of FIG. 21 in extended position.

To assure that square pipe 711 remains centered in the manhole, braces 735 are provided at the downhole end of square pipe 711. Each brace comprises predetermined lengths of apertured square pipe 736 surrounding an identical inner apertured square pipe 737 of smaller dimension in telescoping relation. Inner brace member 737 of braces 735 comprises a brace pad 738 at the end thereof. Brace pad 738 is secured to inner brace member 737 by a universal joint. As depicted in FIG. 21, braces are hingedly connected to brace carrier 739. Brace carrier 739 is, in turn, hingedly connected to square pipe 711. In the stored or retracted position, brace carrier 739 extends at right angles relative to square pipe 711; braces 735 thus extend upwardly parallel to square pipe 711, and are secured thereto by a strap, rope or the like.

To extend or engage braces 735, brace carrier 739 is rotated downwardly, thereby positioning braces 735 at right angles to square pipe 711. Inner brace members 737 are extended until brace pads 738 snugly abut the manhole walls, and are then secured to braces 735. Insertion of the locking pins of locking bars 740 into the appropriate apertures of brace members 735 prevents further movement of inner brace members 737.

After downhole boom 710 is firmly erected in the operating position, cable 719 is unreeled and threaded through pulley 709 down the manhole. A drogue device initially tows cable downstream from the sewer cleaning module to mobile towing unit 700. Ultimately cable 719 is connected thereto and towing of sewer cleaning module 11 commences. Upon termination of towing, downhole boom 710 is returned to the travelling position aboard mobile towing unit 700 by reversal of the erection sequence.

In the alternative embodiments of the system, towing unit 700 tows sewer cleaning module 11 at a rate commensurate with sediment load, amount of scale deposit, degree of compaction, and total volume of sewage. Normally, towing unit 700 tows sewer cleaning module 11 at a constant speed based upon the average depth of silt and pipe diameter within the sewer line 10 being cleaned. Speed is controlled by a computer and appropriately programmed software.

Upon termination of cleaning the sewage line section, the sewer cleaning module is disconnected, disassembled, and raised, together with hoses and cables from the units.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. Apparatus for cleaning an interior of a pipeline through which passes a waste fluid composed of liquid waste mixed with solid waste, said apparatus comprising:

extracting means for extracting waste fluid from the interior of the pipeline;

separating means for separating the thus extracted waste fluid into a thus separated solid waste and a thus separated liquid waste, said separating means comprising a liquid waste holding tank, a solid waste receptacle, and an elevated separator screen onto which the thus extracted waste fluid is deposited;

said elevated separator screen being positioned with respect to said liquid waste holding tank and said solid waste receptacle so that, as waste fluid is deposited on said elevated separator screen, liquid from the thus deposited waste fluid falls through the elevated separator screen and then drops into the liquid waste holding tank while waste solids from the thus deposited waste fluid move off the screen into the solid waste receptacle; and means for removing waste solids from said solid waste receptacle;

in combination with independent means for transporting the thus removed waste solids away from said apparatus while said apparatus is in operation.

2. A combination in accordance with claim 1, where said independent means for transporting comprises a dump truck.

3. Apparatus for cleaning an interior of a pipeline through which passes a waste fluid composed of liquid waste mixed with solid waste, said apparatus comprising:

extracting means for extracting waste fluid from the interior of the pipeline;

separating means for separating the thus extracted waste fluid into a thus separated solid waste and a thus separated liquid waste, said separating means comprising a liquid waste holding tank, a solid waste receptacle, and an elevated separator screen onto which the thus extracted waste fluid is deposited;

said elevated separator screen being positioned with respect to said liquid waste holding tank and said solid waste receptacle so that, as waste fluid is deposited on said elevated separator screen, liquid from the thus deposited waste fluid falls through the elevated separator screen and then drops into the liquid waste holding tank while waste solids from the thus deposited waste fluid move off the screen into the solid waste receptacle; and means for removing waste solids from said solid waste receptacle;

wherein said means for removing waste solids from said solid waste receptacle comprises a valve, whereby the opening of said valve permits waste solids to fall from said solid waste receptacle by force of gravity.

4. Apparatus in accordance with claim 3, wherein said means for removing waste solids from said solid waste receptacle further comprises a conveyor belt having a portion thereof positioned below said valve, and wherein said solid waste receptacle is a solids hopper, said valve being mounted in a bottom of said solids hopper for releasing contents of said solids hopper onto said conveyor belt.

5. Apparatus for cleaning an interior of a pipeline through which passes a waste fluid composed of liquid waste mixed with solid waste, said apparatus comprising:

extracting means for extracting waste fluid from the interior of the pipeline;

separating means for separating the thus extracted waste fluid into a thus separated solid waste and a thus separated liquid waste, said separating means comprising a liquid waste holding tank, a solid waste receptacle, and an elevated separator screen onto which the thus extracted waste fluid is deposited;

said elevated separator screen being positioned with respect to said liquid waste holding tank and said solid waste receptacle so that, as waste fluid is deposited on said elevated separator screen, liquid from the thus deposited waste fluid falls through the elevated separator screen and then drops into the liquid waste holding tank while waste solids from the thus deposited waste fluid move off the screen into the solid waste receptacle; and means for removing waste solids from said solid waste receptacle;

wherein said means for removing waste solids from said solid waste receptacle comprises a conveyor having a first end portion thereof associated with said solid waste receptacle for receiving and conveying waste solids away from said solid waste receptacle.

6. Apparatus in accordance with claim 5, wherein said extracting means for extracting waste fluid from the interior of the pipeline comprises an extraction hose and a slurry pump disposed in the pipeline.

7. An apparatus in accordance with claim 1, further comprising a cleaning module adapted to be inserted within the pipeline and be easily moved along the pipeline, said cleaning module serving to agitate any sediments within the pipeline.

8. Apparatus in accordance with claim 7, wherein said extracting means comprises a slurry pump adapted to be disposed in the interior of the pipeline, and an extraction hose for passing waste fluid from the slurry pump and depositing the thus extracted waste fluid onto said elevated separator screen.

9. Apparatus in accordance with claim 7, wherein said means for removing waste solids from said solid waste receptacle comprises a conveyor having a first end portion thereof associated with said solid waste receptacle for receiving and conveying waste solids away from said solid waste receptacle.

10. Apparatus in accordance with claim 9, wherein said conveyor is a continuous belt conveyor.

11. Apparatus in accordance with claim 9, wherein said conveyor is an inclined conveyor with a second end portion thereof being positionable above said first end portion for transferring the contents of the solid waste receptacle to a point exterior of said apparatus.

12. Apparatus in accordance with claim 5, wherein the elevated separator screen is inclined to the horizontal so that, as waste fluid is deposited on said elevated separator screen, waste solids slide and tumble by gravity down the inclined separator screen and fall off the inclined separator screen into the solid waste receptacle.

13. Apparatus in accordance with claim 5, wherein said waste fluid further comprises suspended particulates, and wherein said apparatus further comprises at least one separator, first conduit means for passing liquid and suspended particulates from said liquid waste holding tank to said at least one separator for separating out at least a portion of the particulates to thereby produce a separated liquid waste which is substantially free of suspended particulates.

14. Apparatus in accordance with claim 13, further comprising a second conduit means for passing the thus separated particulates to said solid waste receptacle.

15. Apparatus in accordance with claim 13, wherein each said at least one separator comprises a cyclone separator.

16. Apparatus in accordance with claim 5, wherein said liquid waste holding tank is positioned directly below the elevated separator screen.

17. An apparatus for cleaning an interior of a pipeline through which passes a waste fluid composed of liquid waste mixed with suspended particulates and sludge, said pipeline containing accumulated sludge and sediment, said apparatus comprising:

a cleaning module adapted to be inserted within the pipeline and be easily moved along the pipeline, said cleaning module serving to agitate sludge and sediments within the pipeline;

extracting means for extracting waste fluid from the interior of the pipeline;

separating means for separating the thus extracted waste fluid into a thus separated solid waste and a thus separated liquid waste, said separating means comprising a liquid waste holding tank, a solid waste receptacle, and a screen onto which the thus extracted waste fluid is deposited, said screen being positioned with respect to said liquid waste holding tank and said solid waste receptacle so that liquid and suspended particulates fall through the screen and into the liquid waste holding tank while solid waste moves off the screen into the solid waste receptacle; and a conveyor having a first end portion thereof associated with said solid waste receptacle for receiving and conveying solid waste from said solid waste receptacle;

wherein said solid waste receptacle is a solids hopper equipped with a bottom valve for releasing contents of the solids hopper onto said conveyor, and wherein said conveyor is an inclined continuous belt conveyor with the first end portion thereof positioned beneath said solids hopper, and wherein a second end portion of said conveyor is positionable above said first end portion for transferring the contents of the solids hopper to a point exterior of said apparatus.

18. A method for cleaning an interior of a pipeline through which passes a waste fluid composed of liquid waste mixed with waste solids, said method comprising the steps of:

extracting waste fluid from the interior of the pipeline;

depositing the thus extracted waste fluid onto an elevated separator screen, said elevated separator screen being positioned directly above a liquid waste holding tank and adjacent to a solid waste receptacle so that, as waste fluid is deposited on said elevated separator screen, liquid from the thus deposited waste fluid falls through the elevated separator screen and then drops into the liquid waste holding tank while waste solids from the thus deposited waste fluid move off the screen into the solid waste receptacle, thereby separating the deposited waste fluid into thus separated waste solids and a thus separated liquid waste; and removing waste solids from said solid waste receptacle;

wherein the step of extracting waste fluid comprises placing a flow baffle in the interior of the pipeline downstream of an extraction point so as to partially occlude the pipeline to reduce the movement of waste solids past the extraction point while permitting some passage of liquid waste past the extraction point, and extracting a portion of the waste fluid at the extraction point.

19. A method for cleaning an interior of a pipeline through which passes a waste fluid composed of liquid waste mixed with waste solids, said method comprising the steps of:

extracting waste fluid from the interior of the pipeline;

depositing the thus extracted waste fluid onto an elevated separator screen, said elevated separator screen being positioned directly above a liquid waste holding tank and adjacent to a solid waste receptacle so that, as waste fluid is deposited on said elevated separator screen, liquid from the thus deposited waste fluid falls through the elevated separator screen and then drops into the liquid waste holding tank while waste solids from the thus deposited waste fluid move off the screen into the solid waste receptacle, thereby separating the deposited waste fluid into thus separated waste solids and a thus separated liquid waste;

removing waste solids from said solid waste receptacle; and transporting the thus removed waste solids away from the location of the pipeline while simultaneously conducting the steps of extracting and separating waste fluid.

20. A method in accordance with claim 19, wherein the elevated separator screen is inclined to the horizontal so that, as waste fluid is deposited on said elevated separator screen, waste solids slide and tumble by gravity down the inclined separator screen and fall off the inclined separator screen into the solid waste receptacle.

21. A method in accordance with claim 19, wherein said waste fluid further comprises suspended particulates, and wherein said method further comprises passing liquid and suspended particulates from said liquid waste holding tank to at least one cyclone separator for separating out at least a portion of the particulates to thereby produce a separated liquid waste which is substantially free of suspended particulates.

22. A method in accordance with claim 19, wherein said step of removing waste solids from said solid waste receptacle comprises transferring the thus removed waste solids to a waiting dump truck while simultaneously conducting the steps of extracting and separating waste fluid.

23. A method for cleaning an interior of a pipeline through which passes a waste fluid composed of liquid waste mixed with waste solids, said method comprising the steps of:

extracting waste fluid from the interior of the pipeline;

depositing the thus extracted waste fluid onto an elevated separator screen, said elevated separator screen being positioned directly above a liquid waste holding tank and adjacent to a solid waste receptacle so that, as waste fluid is deposited on said elevated separator screen, liquid from the thus deposited waste fluid falls through the elevated separator screen and then drops into the liquid waste holding tank while waste solids from the thus deposited waste fluid move off the screen into the solid waste receptacle, thereby separating the deposited waste fluid into thus separated waste solids and a thus separated liquid waste; and removing waste solids from said solid waste receptacle;

wherein the step of removing waste solids from said solid waste receptacle comprises conveying waste solids away from a lower portion of said solid waste receptacle when a substantial quantity of the thus separated solid waste has accumulated in the solid waste receptacle.

24. A method in accordance with claim 23, wherein said step of conveying waste solids is accomplished while the step of depositing the thus extracted waste fluid onto said elevated separator screen is being conducted.

25. A method in accordance with claim 24, further comprising transferring the thus conveyed waste solids to a waiting dump truck.

26. A method in accordance with claim 23, further comprising transferring the thus conveyed waste solids to a waiting dump truck.

* * * * *